US011787655B2

(12) United States Patent
Van De Hey et al.

(10) Patent No.: US 11,787,655 B2
(45) Date of Patent: Oct. 17, 2023

(54) VARIABLE ROLL CAGE MACHINE AND PROCESS

(71) Applicant: C3 Corporation, Appleton, WI (US)

(72) Inventors: Joseph F. Van De Hey, Kaukauna, WI (US); Alex M. Zirbel, Kaukauna, WI (US); Alex N. Kuffel, Appleton, WI (US); David M. DeHaai, Greenville, WI (US); Jeffery J. VanHandel, Freedom, WI (US)

(73) Assignee: C3 Corporation, Appleton, WI (US)

( * ) Notice: Subject to any disclaimer, the term of this patent is extended or adjusted under 35 U.S.C. 154(b) by 236 days.

(21) Appl. No.: 17/081,639

(22) Filed: Oct. 27, 2020

(65) Prior Publication Data

US 2022/0097991 A1 Mar. 31, 2022

Related U.S. Application Data

(60) Provisional application No. 63/084,546, filed on Sep. 28, 2020.

(51) Int. Cl.
*B65H 18/16* (2006.01)

(52) U.S. Cl.
CPC ..... *B65H 18/16* (2013.01)

(58) Field of Classification Search
CPC ..... B65H 18/023; B65H 18/16; B65H 18/22; B65H 2404/2692
See application file for complete search history.

(56) References Cited

U.S. PATENT DOCUMENTS

| | | | |
|---|---|---|---|
| 3,052,073 | A | 9/1962 | Johansen et al. |
| 4,164,177 | A | 8/1979 | Canfield |
| 4,583,697 | A | 4/1986 | Bichot et al. |
| 4,711,067 | A | 12/1987 | Magni |

(Continued)

FOREIGN PATENT DOCUMENTS

| | | | |
|---|---|---|---|
| CN | 105292552 | A | 2/2016 |
| CN | 105599978 | B | 1/2018 |

(Continued)

OTHER PUBLICATIONS

C3 Corporation, description by Applicant of its machine and process for making compressed rolled up product from high expansion force material, like a mattress, the machine and process has been available to the public at least as early as Sep. 1, 2019, 3 pages filed herewith.

(Continued)

*Primary Examiner* — Sang K Kim
(74) *Attorney, Agent, or Firm* — Amundsen Davis, LLC

(57) ABSTRACT

A variable roll cage machine and process to roll up material, like high expansion force material. The machine includes a roll chamber to receive the material. The roll chamber has a longitudinal central axis and a plurality of rollers located around a circumference of the roll chamber. The plurality of rollers include two roll groups of at least two rollers in each roll group. At least one of the rollers in each roll group is movable toward the longitudinal central axis independent of at least one other roller in the roll group. A material infeed gap is in the circumference of the roll chamber located between the two roll groups and spaced from the at least one of the rollers in each roll group that is movable.

53 Claims, 18 Drawing Sheets

(56) References Cited

U.S. PATENT DOCUMENTS

| | | | | |
|---|---|---|---|---|
| 5,305,963 | A * | 4/1994 | Harvey, III | B65B 63/024 242/541.2 |
| 5,425,512 | A | 6/1995 | Bichot et al. | |
| 5,934,041 | A | 8/1999 | Rudolf et al. | |
| 6,298,510 | B1 | 10/2001 | Mossbeck | |
| 6,739,107 | B1 | 5/2004 | Lewis et al. | |
| 7,100,862 | B2 | 9/2006 | Skarzenski et al. | |
| 8,046,973 | B2 | 11/2011 | Petrolati | |
| 9,701,504 | B2 * | 7/2017 | Van Gurp | B65H 18/22 |
| 2005/0056163 | A1 | 3/2005 | Skarzenski et al. | |
| 2007/0119126 | A1 | 5/2007 | Anderson et al. | |
| 2008/0149755 | A1 * | 6/2008 | Niklaus | B65H 18/22 242/526 |
| 2015/0166287 | A1 | 6/2015 | Gurp et al. | |
| 2015/0203221 | A1 | 7/2015 | Hey et al. | |

FOREIGN PATENT DOCUMENTS

| | | | |
|---|---|---|---|
| CN | 108100337 | A | 6/2018 |
| EP | 0705199 | B1 | 3/1998 |
| FI | 20010621 | A | 10/2002 |
| KR | 101860373 | B1 | 5/2018 |

OTHER PUBLICATIONS

C3 Corporation, "CF1596 Compress and Roll Pack Machine" YouTube Video, published on or before Sep. 23, 2020 at https://www.youtube.com/watch?v=jtlsvdRpROc, retrieved from the Internet on or before Sep. 23, 2020, 54 pages filed herewith.

Search Report & Written Opinion for PCT Patent Application No. PCT/US2021/050891, "Variable Roll Cage" dated Feb. 28, 2022, 17 pages filed herewith.

C3 Corporation, "Behind the Design: Variable Roll Cage" YouTube Video, retrieved from the internet on or before Sep. 23, 2020 at https://www.youtube.com/watch?v=rkebK_ztBbA, retrieved from the internet on Sep. 23, 2020, 23 pages filed herewith.

C3 Corporation, "C3's Block Compression System with Variable Cage" YouTube Video, retrieved from the internet on or before Sep. 23, 2020 at https://www.youtube.com/watch?v=KGdFOQMcAxA, retrieved from the internet on Sep. 23, 2020, 24 pages filed herewith.

C3 Corporation, "CF1396 Compression Folding System with Variable Cage" YouTube Video, retrieved from the internet on or before Sep. 23, 2020 at https://www.youtube.com/watch?v=hc9txgAAS78, retrieved from the internet on Sep. 23, 2020, 26 pages filed herewith.

C3 Corporation, "CF1396 Roll Packaging Machine with Box Line" YouTube Video, retrieved from the internet on or before Sep. 23, 2020 at https://www.youtube.com/watch?v=ZJCmmnkWkCY, retrieved from the internet on Sep. 23, 2020, 44 pages filed herewith.

Esun International Co, Ltd., "EF-60 Full Automatic Mattress Compress and Roll Packing Production Line" YouTube Video, retrieved from the internet on or before Sep. 23, 2020 at https://www.youtube.com/watch?v=fkBwvDPXTrM, retrieved from the internet on Sep. 23, 2020, 87 pages filed herewith.

Esun International Co, Ltd., "EF-60 Full Automatic Mattress Compress and Roll Packing Production Line", published on or before Sep. 23, 2020 at https://www.eachsun.com/products/326.html, retrieved from the internet on Sep. 23, 2020, 1 page filed herewith.

International Preliminary Report on Patentability for PCT Patent Application No. PCT/US2021/050891, "Variable Roll Cage" dated Feb. 17, 2023, 3 pages filed herewith.

* cited by examiner

VARIABLE ROLL CAGE MACHINE AND PROCESS

CROSS-REFERENCE TO RELATED APPLICATION

This application claims the benefit of U.S. Provisional Application No. 63/084,546, filed Sep. 28, 2020, and titled: VARIABLE ROLL CAGE FOR COMPRESSED HIGH EXPANSION FORCE MATERIAL.

TECHNICAL FIELD

This invention relates to rolling up of material in a commercial setting to aid in packaging the same. More specifically, it concerns a variable roll cage machine and process to roll up compressed material into compressed rolls. Such rolls are easier and less expensive to handle, store and ship.

BACKGROUND

In many industries, large quantities of compressible materials must be stored and transported around. Compressing these materials into smaller volumes often results in significant cost savings, but can also cause product defect or pre-mature product degradation. Compressible foam materials such as polyurethane foam layers or other foam types as various combinations of layers like a mattress, including pockets of coils and springs for use in mattress construction, are just a few examples of materials which are more efficiently handled in a compressed form for storage and shipping.

To be compressed, such products are also often folded, rolled, folded and rolled, or rolled and rolled, to attain an even smaller package size. The rolling/folding/combination operation is often preceded by a stage of compressing the compressible materials, and in particular a mattress, in order to first reduce the thickness thereof and therefore reduce the maximum diameter of a packaged product when formed into a spiral-rolled product. The compressible product is wrapped in loose plastic or plastic-like material, and then compressed in a press, often times highly compressed to a volume six times to twelve times less than its pre-compressed volume. At the end of the compressing action that substantially flattens the once thick material to about 0.5 inch to about 2 inches in height, a welding bar is activated to join and seal the side flaps of the plastic wrapping the mattress product, thus sealing the product inside the plastic from the outside environment, and preventing the mattress from readily expanding back to its pre-compressed height and volume after the press is opened due to the restrictive plastic wrapping.

The compressed mattress product then advances along in flattened form to a machine and process for spiral-rolling of the product and storage of the rolled product can occur for example, by insertion in a pre-formed bag or being wrapped with stretch wrap as part of the spiral-rolling process near the time rolling of the product concludes in the rolling machine. Additionally, this spiral rolled product can then be subjected to a further rolling process to further reduce the overall size of the rolled material, a so-called roll of a roll. All of this is toward the goal of wrapping the compressible product wound up on itself in a very tight manner so as to prevent it from occupying too great a volume during transport and storage. The greater the compression ratio of the product, the cheaper the transport and storage. However, if the product is rolled too tightly and/or not wound with appropriate pressure, the tight rolling process will damage the layers, their cells and/or fibers, as well as the binder which joins layer to layer within the product.

It is also important for the series of operations, and in particular the rolling process which tends to be a bottleneck in an assembly line, to be performed at a sufficient speed to be compatible with the line speeds of the product before and after the rolling step in the production line. This point is particularly important for modern lines whose production capability it is often desired to increase. From this point of view, it is important for the spiral rolling machine to avoid non-productive times. The ideal rolling machine is a machine which would wind the product at the speed at which it passes down the production line without any non-productive time between the end of rolling up one product and the beginning of rolling up the next product.

Accordingly, there are a variety of characteristics to consider when making a compressible material, such as a mattress product, into a smaller product footprint for storage and shipping. Often these compete with each other and even move each other in opposite directions. Thus, there is a need to address one or more of the deficiencies in the art to better aid in achieving desirable characteristics and/or avoid negative ones, toward the ultimate use of the rolled compressible material after it completes it packing, storage and transit, and arrives at an end user. The user will unpackage and unwrap the tightly compressed and rolled up material, and it should quickly expand. Ideally, the material expands to its pre-compressed size and shape and is usable as if it had never been compressed and subject to such packaging forces. However, that is often not the case with rolling equipment and processes available today. And, even when such is possible, the machines and/or processes used today could be enhanced to increase their efficiency, effectiveness, and/or flexibility to roll up more or different types of compressible products.

This invention harnesses the inventors' knowledge and insights that preferably one should roll a coiled product to a diameter, i.e., calculate the diameter base density and set the diameter, and even more preferably, that the coiled product sees a relatively consistent pressure from the center out during rolling up, especially when dealing with a high expansion force material, like a compressed mattress. The inner part of the rolled product verses the outer part of the rolled or coiled product has a smaller diameter that is preferably managed with minimal to no crushing of the center portion of the rolled product. Prior art designs wind from the center out causing damage, especially near the center of the rolled product, and overall poor or varying final diameters, especially when dealing with a high expansion force material, like a compressed mattress. By setting the diameter, and winding from the outside in, and thereby also, preferably, having a more consistent pressure throughout the wind, then, desirably, repeat diameters are more easily and consistently achieved, there can be better managed compression set, less work is required, and/or a more consistent packaged product results when put into use as intended. This is even more important for a material product that is compressed for a period of time, namely shipment, and then is unpackaged and must return to its original, uncompressed shape, size, and resilient characteristics.

SUMMARY

To address one or more deficiencies in the art and/or better achieve the desirable characteristics in packaging, storing and/or ultimately using rolled compressible material, there is provided a variable roll cage machine to roll up compressed high expansion force material. The machine includes a roll chamber to receive the material. The roll chamber has a longitudinal central axis and a plurality of rollers located around a circumference of the roll chamber. The plurality of rollers include two roll groups. Each roll group includes two rollers. One of the rollers in each roll group is movable toward the longitudinal central axis independent of one other roller in the roll group. Two of the rollers in each roll group have a longitudinal axis and the longitudinal axes of the two rollers in each roll group are fixed relative to each other. A material infeed gap is in the circumference of the roll chamber located between the two roll groups and spaced from the one of the rollers that is movable in each roll group.

In a different embodiment there is a variable roll cage machine to roll up material. The machine includes a roll chamber to receive the material. The roll chamber is beltless and has a longitudinal central axis and a plurality of rollers located around a circumference of the roll chamber. The plurality of rollers include two roll groups. Each roll group includes two rollers. One of the rollers in each roll group is movable toward the longitudinal central axis independent of one other roller in the roll group. The roll chamber includes a material infeed gap in the circumference of the roll chamber located between the two roll groups and spaced from one of the rollers that is movable in each roll group.

One embodiment of a process is a process for rolling up compressed high expansion force material. One step is forming a roll chamber. The roll chamber has a longitudinal central axis and a plurality of rollers located around a circumference of the roll chamber. Next is forming the plurality of rollers into two roll groups, each roll group including two rollers. Then, driving the material into the roll chamber against at least one of the plurality of rollers. And another step is rolling the plurality of rollers to cause the nose of the material to travel along the circumference of the roll chamber as material continues to enter the roll chamber. Followed by the step moving one of the rollers in each of the two roll groups. In this step, moving one of the rollers away from the longitudinal central axis independent of one other roller in the roll group. And also, moving one of the rollers from a first position to a final position, where the first position is located closer to the longitudinal central axis than the final position is located to the longitudinal central axis. And a final step is maintaining the two roll groups in the final position until the material is completely inside the roll chamber and finished rolling up.

Another embodiment of the process is a process for rolling up material. The process includes various steps, as follows. One step is forming a roll chamber. The roll chamber has a longitudinal central axis and a plurality of rollers located around a circumference of the roll chamber. A next step is forming the plurality of rollers into two roll groups, each roll group including two rollers. And then, the step moving the two roll groups into a pre-determined first position defining a first diameter of the roll chamber before the material enters a nip area upstream of the roll chamber. And, step driving the material toward the roll chamber. Followed by moving the two roll groups into a pre-determined second position defining a second diameter of the roll chamber as the material enters the nip area, with the second diameter being greater than the first diameter. Another step is driving a nose of the material into the roll chamber and against at least one of the plurality of rollers. Next, is step rolling the plurality of rollers to cause the nose of the material to travel along the circumference of the roll chamber as material continues to enter the roll chamber. And another step is, moving the two roll groups into a pre-determined final position defining a third diameter of the roll chamber as the material continues to enter the roll chamber and before the nose of the material is about to impact a middle portion of the material entering the roll chamber, with the third diameter being greater than the second diameter. And a further step is maintaining the two roll groups in the pre-determined final position until the material is completely inside the roll chamber and finished rolling up . . . .

Also described herein are options directed to roll group features and configurations individually and relative to other groups, roller features individually and relative to other rollers, and roll chamber features and configurations.

As used herein, "high expansion force material" means a material that is (i) reduced in volume by flattening it to a flattened volume that is at least two times less than its pre-compressed volume, and preferably reduced to a flattened volume that is at least four times less than its pre-compressed volume, more preferably at least 6 times, at least 8 times or at least 10 times, and (ii) the material is resilient to recover to at least about 90% of its pre-compressed volume, preferably to at least about 95% of its pre-compressed volume and more preferably 98%, when at a temperature of about 70 degrees Fahrenheit for a period of one hour and the restrictive means causing it to be reduced in volume is removed from the material.

BRIEF DESCRIPTION OF THE DRAWINGS

The invention may be more completely understood in consideration of the following detailed description of various embodiments in connection with the accompanying drawings, in which.

Figure 1:
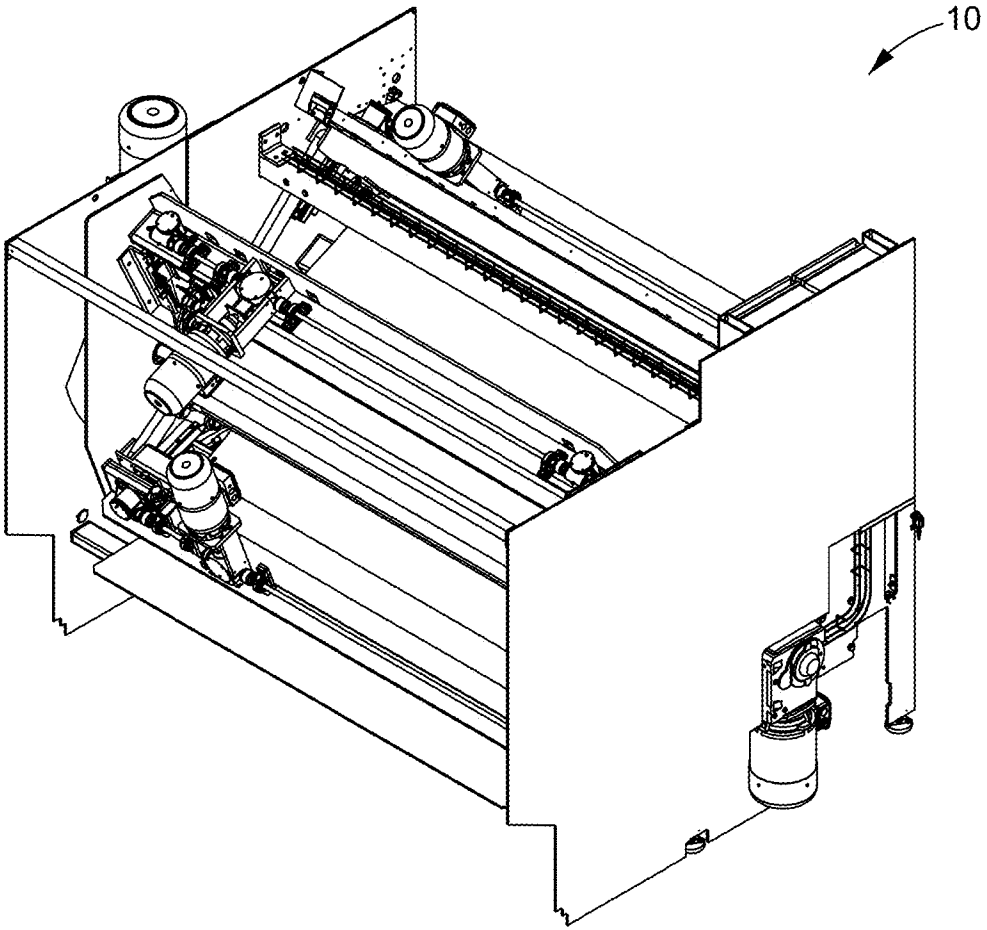
FIG. 1 is a perspective view of the variable roll cage machine.

The drawings show some but not all embodiments. The elements depicted in the drawings are illustrative and not necessarily to scale, and the same (or similar) reference numbers denote the same (or similar) features throughout the drawings.

DETAILED DESCRIPTION

Figure 2:
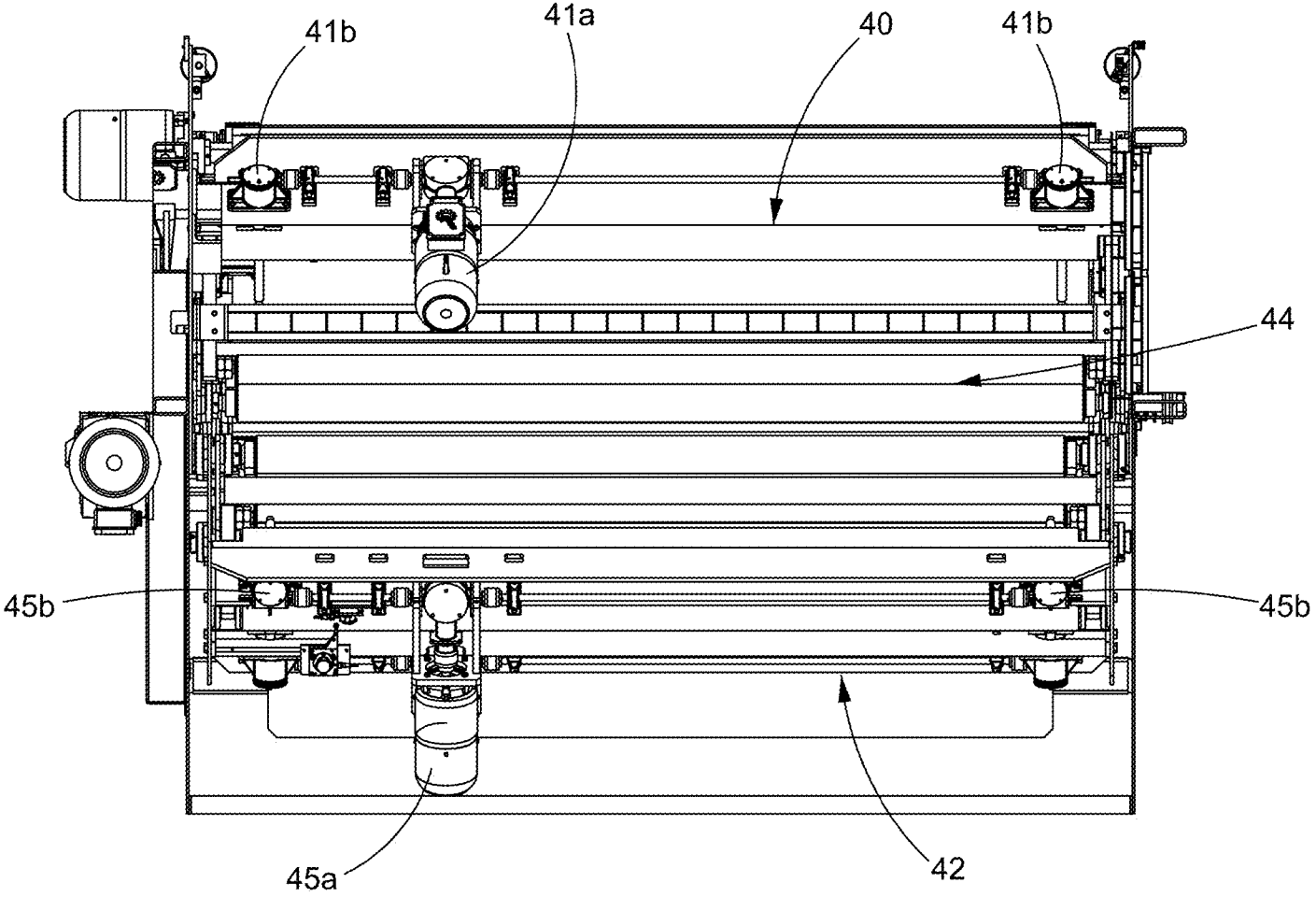
FIG. 2 is a top view of that seen in FIG. 1.
Figure 3:
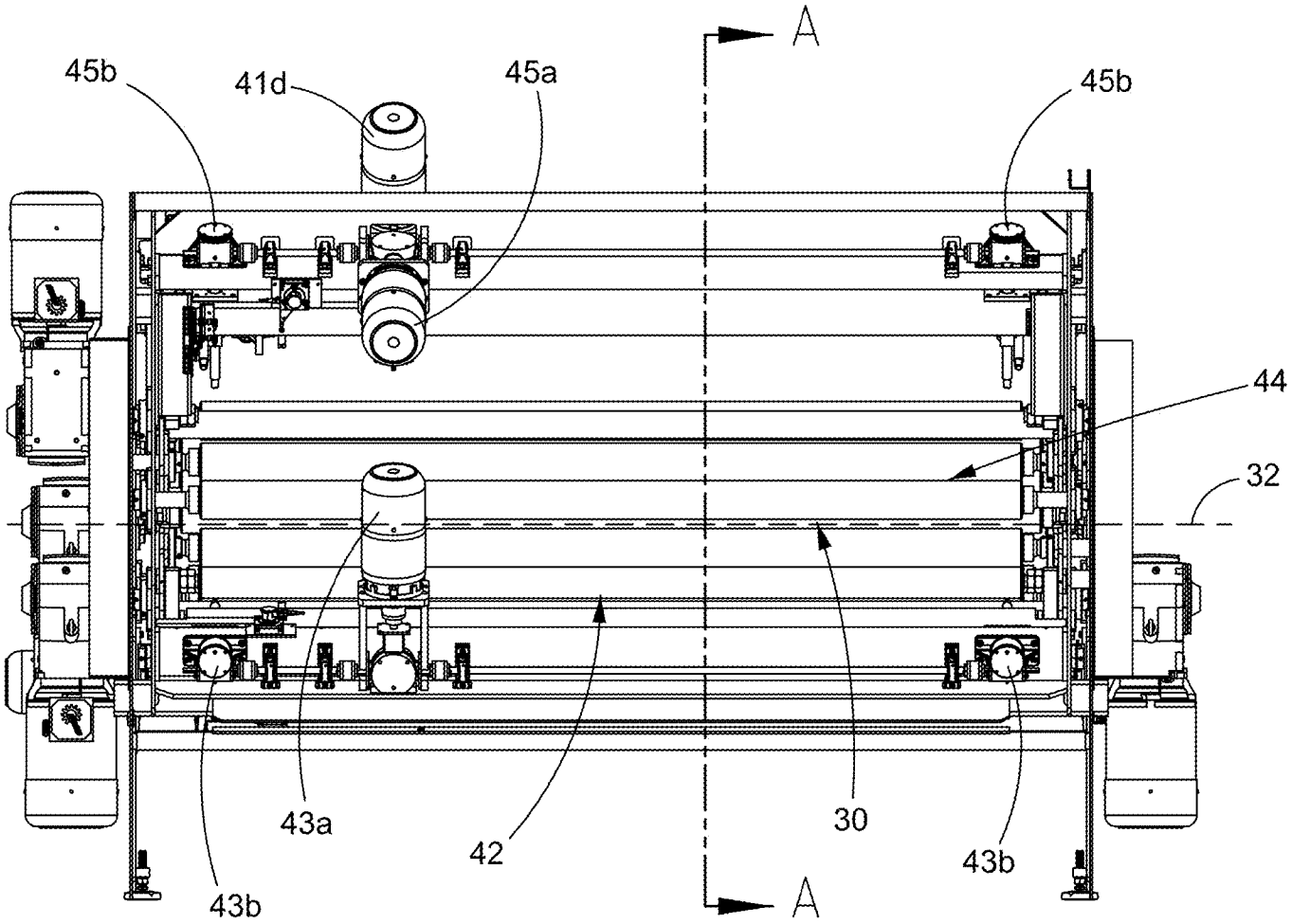
FIG. 3 is a backside view of that seen in FIG. 1.
Figure 4:
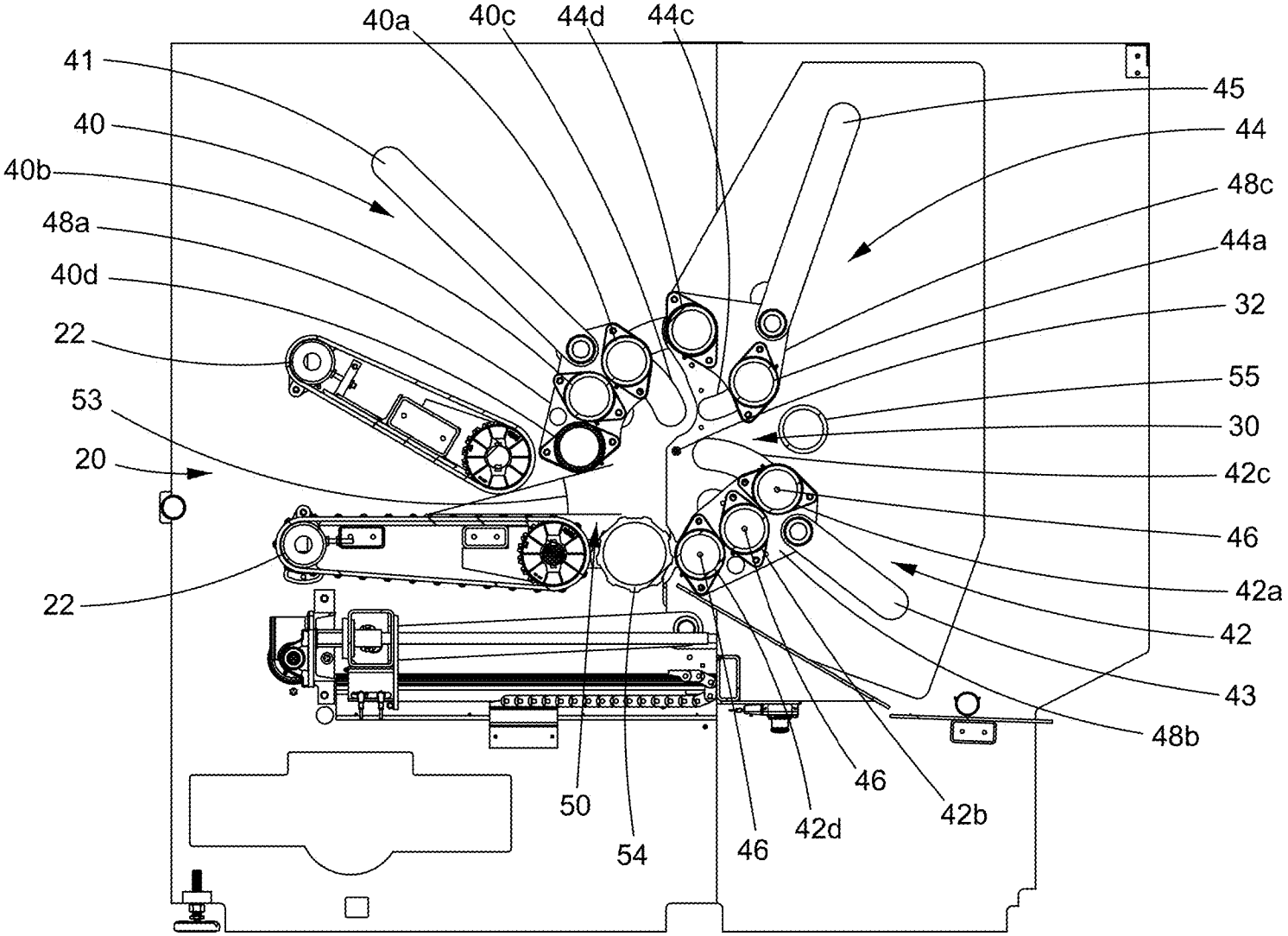
FIG. 4 is a cross-sectional schematic side view of that in FIG. 3, taken along the line A-A.

In accordance with the practice of at least one embodiment, as seen in FIGS. 1-4 and 13-18 for example, there is a variable roll cage machine 10 to roll up material 12, preferably compressed material and even more preferably high expansion force material, like a mattress. The machine includes a roll chamber 30 to receive the material 12. The roll chamber has a longitudinal central axis 32 and includes a plurality of rollers located around a circumference of the roll chamber. The innermost longitudinal edge of each of the plurality of rollers that will engage the material during roll up coincides with and defines the circumference, and thus the circumference is variable as the rollers move inward and outward relative to the central axis 32. Central axis 32 is defined as the theoretical center point of chamber 30 when the plurality of rollers are in their maximum outward position away from each other in the machine, as seen in FIG. 4 for example. The plurality of rollers include two roll groups 40, 42 of two rollers 40*a*, 40*d* and 42*a*, 42*d* in each roll group. Additionally, preferably, there can be more rollers in each group like a third roller 40*b*, 42*b* shown in groups 40, 42, but can be only two rollers 44*a*, 44*d*, like in a third roll group 44. One of the rollers 40*a*, 42*a* in each roll group is movable toward, and preferably also away from (as discussed in more detail herein), the longitudinal central axis 32 independent of one other roller in the roll group, such as rollers 40*d*, 42*d*, respectively. And, preferably when there are three roll groups, such as group 44, it can also have roller 44*a* movable toward and/or away from longitudinal central axis 32 independent of roller 44*d*. Yet more preferably, when a roll group includes more than two rollers, all but one of the rollers are movable relative to longitudinal central axis 32 independent of one roller in the roll group, such as rollers 40*d*, 42*d*, respectively.

The machine also includes a material infeed gap 50 in the circumference of the roll chamber, and this gap can be located between the two roll groups 40, 42 and spaced from one of the rollers, e.g., 40*a*, 40*b*, 42*a*, 42*b*, in each roll group that is movable relative to the longitudinal central axis 32. In this regard, the spacing includes one roller, e.g. 40*d* and 42*d*, and preferably additionally, lug roller 54 as seen throughout the drawings, separating the movable roller(s) from the gap 50, and even located adjacent to the material infeed gap. Even more preferably, the material infeed gap 50 is located in a bottom portion 36 of the roll chamber, and additionally, the lug roller is located in bottom portion 36 also. The bottom portion is defined by drawing a theoretical horizontal line 36*a* (FIG. 16) through the longitudinal central axis 32 and then the roll chamber below the horizontal line defines the bottom portion 36.

Related to these features and as seen in operation, material 12 is driven into and through gap 50 by a nip area 20 up steam of the roll chamber that receives the flattened material 12 from a prior production process (not shown) from the nip belts 22 that help guide the material through the nip area. Further in this regard, while the nip area uses belts and rollers, preferably the plurality of rollers in chamber 30 are beltless, and more preferably, such that the rollers will directly roll against the material as it is rolled up in the chamber. Still further, preferably, the rollers have a frictional surface to help drive the material during roll up, such as sandpaper-like coating, grit paint, or similar surface to help engage but not damage the product during roll up in the chamber.

Figure 5:
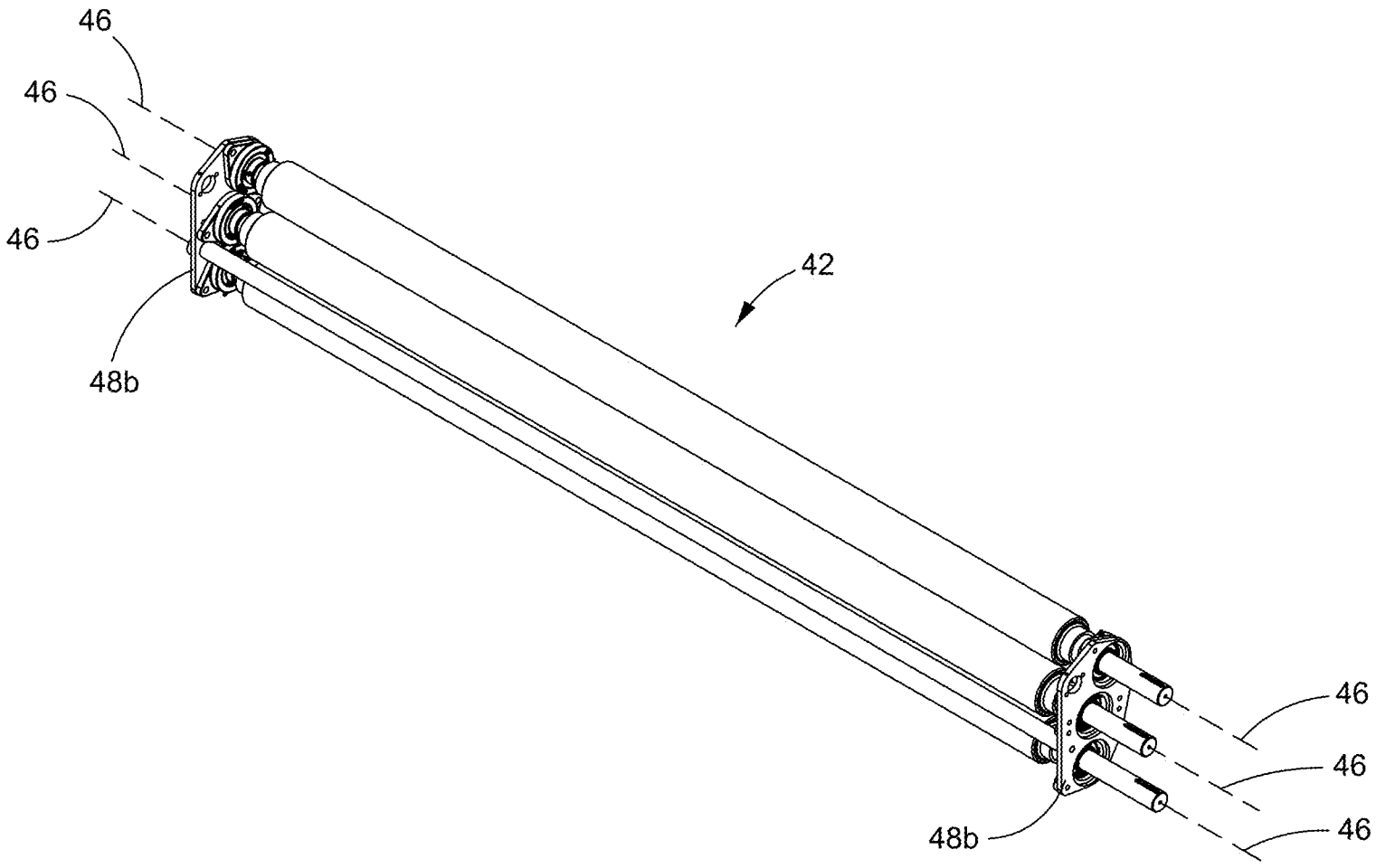
FIG. 5 is a perspective view of a roll group of the plurality of rollers.

In other aspects, the machine 10 can include two of the rollers in the two roll groups, and preferably each roller in each group, having a longitudinal axis, e.g. similar to that depicted as 46 in FIGS. 4-5 for example, and the longitudinal axes of the rollers are fixed relative to each other. That is, in this way the rollers can roll/spin around their longitudinal axes but the rollers in a group do not move closer or further away from each other. For example, this can be achieved by each roller in its group being secured in a movable support like plates 48*a*, 48*b*, 48*c* on either ends of the roll group. Without being limited to a theory of understanding, it is, at least in part, the fixing of rollers in a group relative to each other that can help contribute to a more consistent rolling up of the material and management of the force needed to tightly wind up the material in the roll cage, and can also help more reliably preserve the desirable characteristics of the material for use after shipping and unpacking. That is, the operation of our innovative machine 10, preferably makes it possible to exert a pressure during winding which is constant both in time and in space, thus better avoiding alternating compression and relaxation, or over winding, which damages the material and/or brings about inner material fatigue prematurely. Additionally, as explained further below, compressive forces used to roll up and increase the density of the rolled up material are quite high and if the rollers are not carefully controlled they could fail and/or damage the machine. Further in this regard, it is the pivot of the roll groups (i.e., 40, 42, and 44 if employed) that is preferable to independent radial movement of each cylinder. Without being limited to a theory of understanding, moving the rolls as a group versus each roller individually also help keep the number of moving axes down, to simplify machine operation and yet still provide the flexibility desired.

Related to and building upon one or more of these points, other aspects are directed to certain independent capabilities of parts of the machine. For example, while rollers 40*a*, 42*a* in each roll group are movable toward and/or away from the longitudinal central axis 32 independent of at least one other roller in the roll group, such as rollers 40*d*, 42*d*, respective, preferably this is accomplished by at least one of the rollers, e.g., 40*d*, 42*d*, (and 44*d* when applicable) in each roll group being fixed relative to the longitudinal central axis. That is, and as also encouraged by the theory of understanding stated earlier, having certain rollers of the plurality of rollers, and particularly one roller in each roll group, be fixed relative to the longitudinal central axis 32 helps the variable roll cage better manage the force needed to tightly roll/wind up the material in the roll cage. Additionally, or alternatively, the two roll groups 40, 42 can have at least one roller in each roll group that is movable toward and away from the longitudinal central axis independent of at least one roller in another roll group. That is, and as will be seen in examples discussed herein, roll groups 40, 42 and 44 are, preferably, each having at least one roller movable independent of at least one, and even more preferably all other, roll groups, for added variability of the roll chamber and yet still quality control and management of the material as it is being rolled up.

Turning to other features of the roll chamber, preferably one roller is independent of the two roll groups, even more preferably several may be, and the roller(s) is located around the circumference of the roll chamber and positioned between the two roll groups. For example, this can be rollers 54, 55, 44*a* and/or 44*d*. In this way, there can be greater range of operation for the roll chamber, namely its variable circumference, yet still achieving desired material roll up characteristics and manage the forces in the roll chamber needed to do so. Further, preferably, the roller(s) independent of the two roll groups comprises lug roller 54. Lug roller 54 is defined as such because it has not only a frictional surface, but also a more extreme frictional surface achieved through protruding lugs (e.g., peaks and valleys, where the peaks are at least about one-quarter inch in height as compared to the valleys, and the peaks are spaced from each other in the range of about 2 to 3 inches) located around the circumference and generally running the length of the roller. Additionally, or alternatively, preferably the roller(s) independent of the two roll groups can be two rollers forming third roll group 44, e.g., rollers 44*a* and 44*d*. Further in this regard, preferably, the roller(s) (e.g., 44*a*) in the third roll group is movable toward and/or away from the longitudinal central axis 32 independent of another roller(s) (e.g., 44*d*) in the third roll group.

Figure 18:
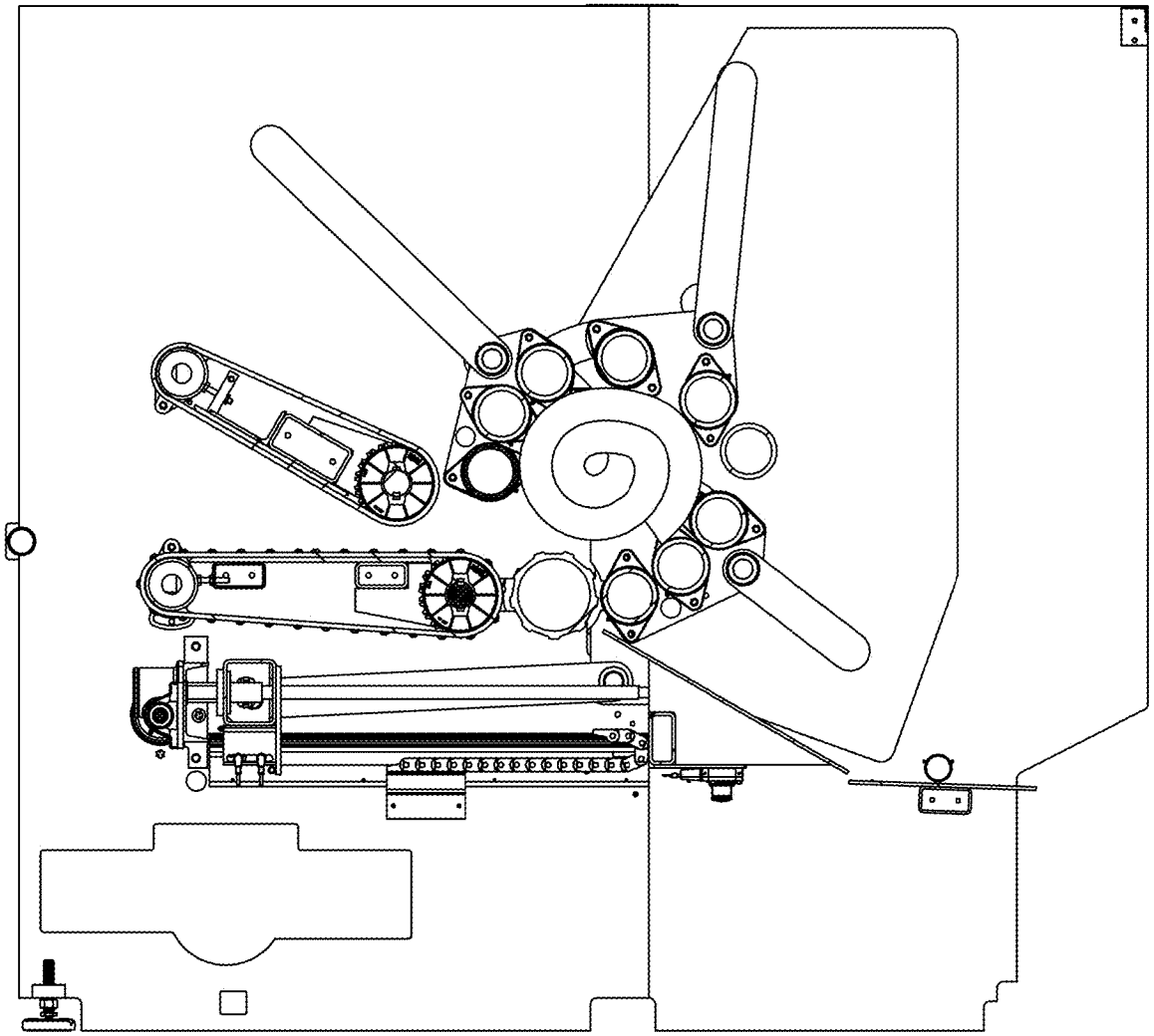
FIG. 18 is a cross-sectional schematic side view similar to that in FIG. 17, but with the rollers now in the final position and the compressed material in the roll chamber is fully rolled up.
Figure 19:
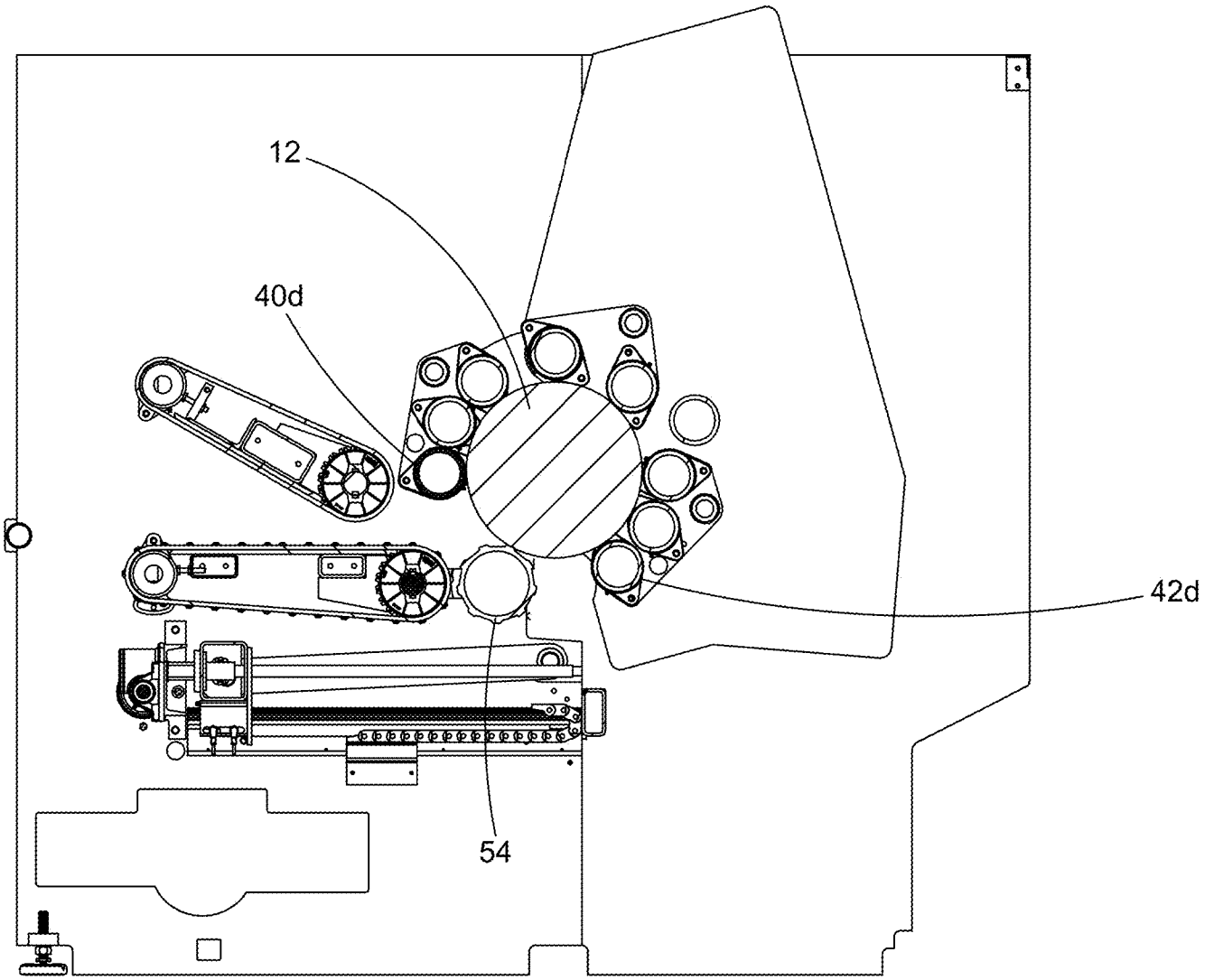
FIG. 19 is a cross-sectional schematic side view similar to that in FIG. 18, but with the roll chamber in the partially closed mode to have even greater roll up capacity and the compressed material in the roll chamber fully rolled up.
Figure 20:
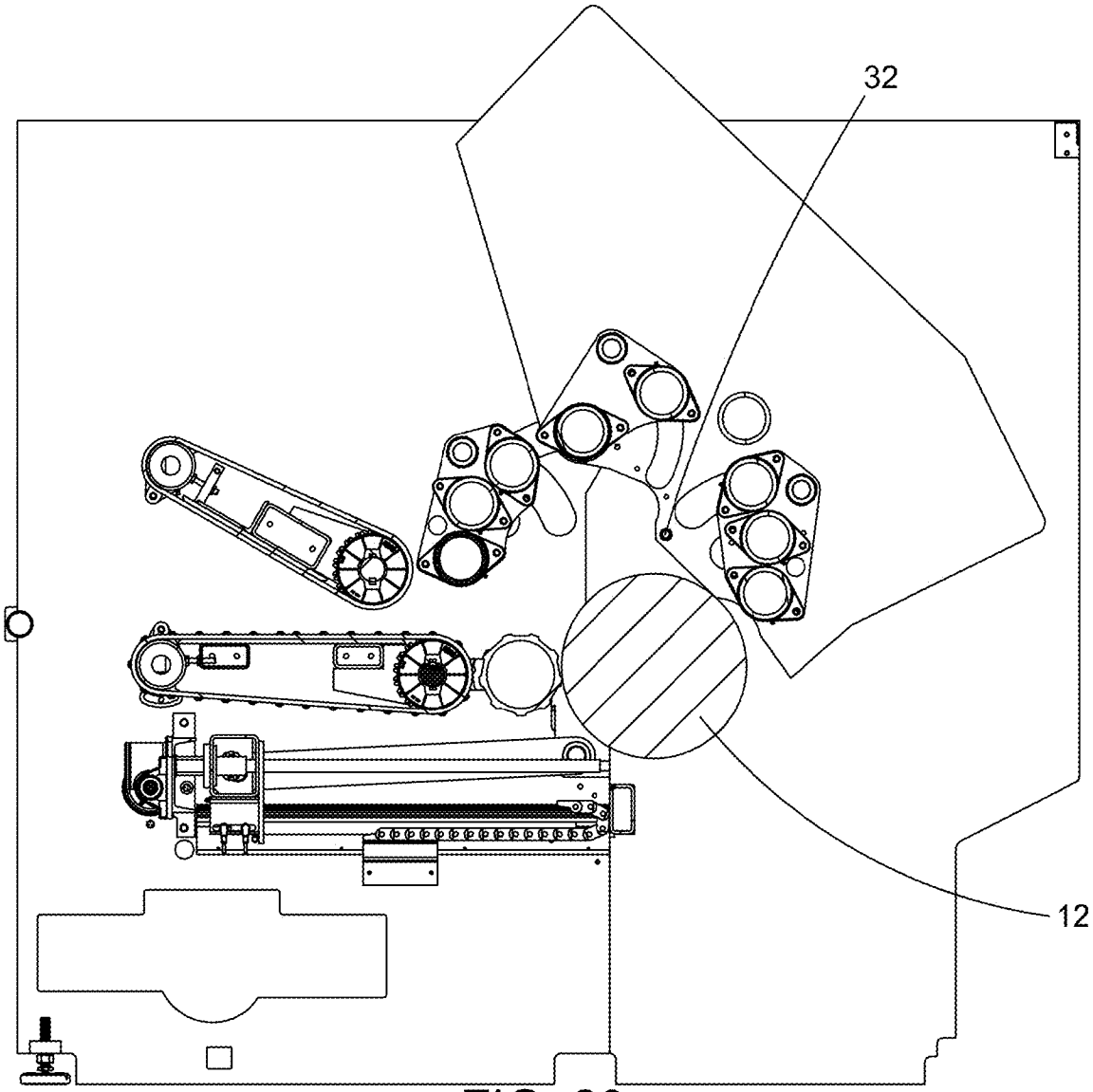
FIG. 20 is a cross-sectional schematic side view of that in FIG. 19, but now with the roll chamber in the open mode and the fully rolled up material exiting the roll chamber; and, FIG. 21 is a cross-sectional schematic side view of that in FIG. 20, with the roll chamber in the open mode and the rolled up material complete out of the roll chamber.
Figure 21:
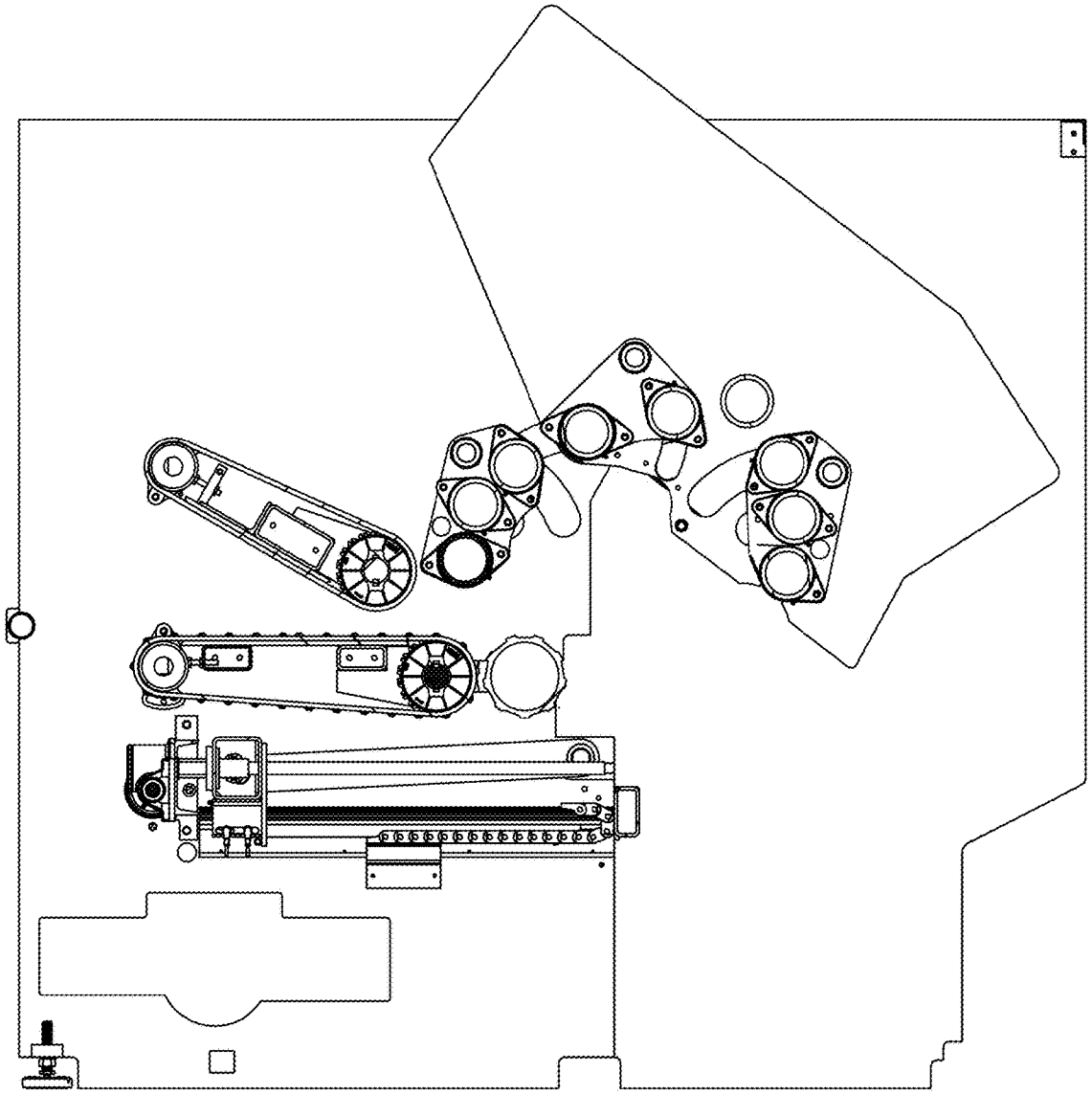

The roll chamber has three modes of operation. These are a closed mode (as seen in most of the Figures), a partially closed mode (as seen in FIG. 19) and an open mode (as seen in FIGS. 20-21). Further, unlike ever before, one of the rollers in the two roll groups being movable is preferably possible in the closed mode. It may also be possible in other modes, but it is preferably possible in at least the closed mode. That is, a preferred feature of the roll chamber is having the roller(s) that is(are) movable in each roll group being able to move and roll up the material while the chamber is in the closed mode. The closed mode means the fixed rollers of the plurality of rollers of the roll chamber are as close as they can be together and they maintain that distance from each other throughout the entire roll up of the material, at least until it is fully rolled up and ready to be ejected from the roll chamber. Slightly differently, the partially closed mode means at least two of the fixed rollers of the plurality of rollers of the roll chamber are not as close as they can be together and are further apart, than their closed mode distance, at some point during the roll up of the material but yet still close enough to allow roll up of the material until the material is rolled up and ready to be ejected from the roll chamber. And, the open mode means at least two of the fixed rollers of the plurality of rollers of the roll chamber are even further apart, than their partially closed mode distance, after the conclusion of roll up of the material to allow the rolled up material to be ejected from the roll chamber. Advantageously, the partially closed mode can provide additional roll up capability to the variable roll cage machine, in the order of about 10%-30% and preferably about 15-25%, because of the greater range of circumference of the roll chamber yet still closed enough to manage the roll up forces encountered, especially with a high expansion force material. Further in this regard, for example, at least two of the roll groups can be spaced from each other a first distance in the closed mode (e.g., FIG. 18, this distance between the fixed rollers in the two roll groups 40, 42) and a second distance in the partially closed mode (e.g., FIG. 19, the distance between fixed roller 40*d*, 42*d* of these roll groups), and the second distance is greater than the first distance. In this way, the additional roll up capability can be achieved through the combined configuration of the fixed rollers and movable rollers, and respective roll groups.

Also disclosed here is a process for rolling up material, preferably compressed material 12, and more preferably high expansion force compressed material, like a mattress. Such process can be employed by machine 10, for example, and as discussed below for reference. The process comprises a variety of steps and while some steps can be performed in any order, some steps have an order dictated by their nature and the results desired, but when this is not the case the order can be varied. In reference to FIGS. 4 and 13-18, for example, the process includes forming roll chamber 30. The roll chamber has longitudinal central axis 32 and includes the plurality of rollers located around the circumference of the roll chamber. Next is forming the plurality of rollers into two roll groups 40, 42. Each roll group includes two rollers, e.g., 40*a* and 40*d*, 42*a* and 42*d*, and can include more rollers if desired, e.g., 40*b* and 42*b*, respectively. Another step is driving the material 12 into the roll chamber 30 against at least one of the plurality of rollers. Preferably the material enters the roll cage in its bottom portion 36, and when so, the nose 14 of the material tends to first impact one or more of rollers 42*d*, 42*b*, 42*a* of the plurality of rollers. As the nose impacts the rollers, the roller are spinning and the next step is rolling the plurality of rollers to cause the nose of the material to travel along the circumference of the roll chamber as material continues to enter the roll chamber. Preferably, the plurality of rollers are directly rolling against the material to roll up the material, that is, there are no belts used around two or more rollers in the roll chamber. Also, preferably, the rollers are spinning, clockwise in this example, thus causing the nose of the material to travel up along the circumference of the roll chamber as material continues to enter the roll chamber. In this way, bottom surface 12*b* will be the outside of the rolled up material and can aid to protect the more valuable top surface 12*a* from damage during roll up, packaging and shipping. Traveling along the circumference of the roll chamber (i.e., in a counterclockwise direction here) also prevents the nose of the material from beginning to roll up on itself too early and helps produce a better rolled product as discussed herein.

Figure 13:
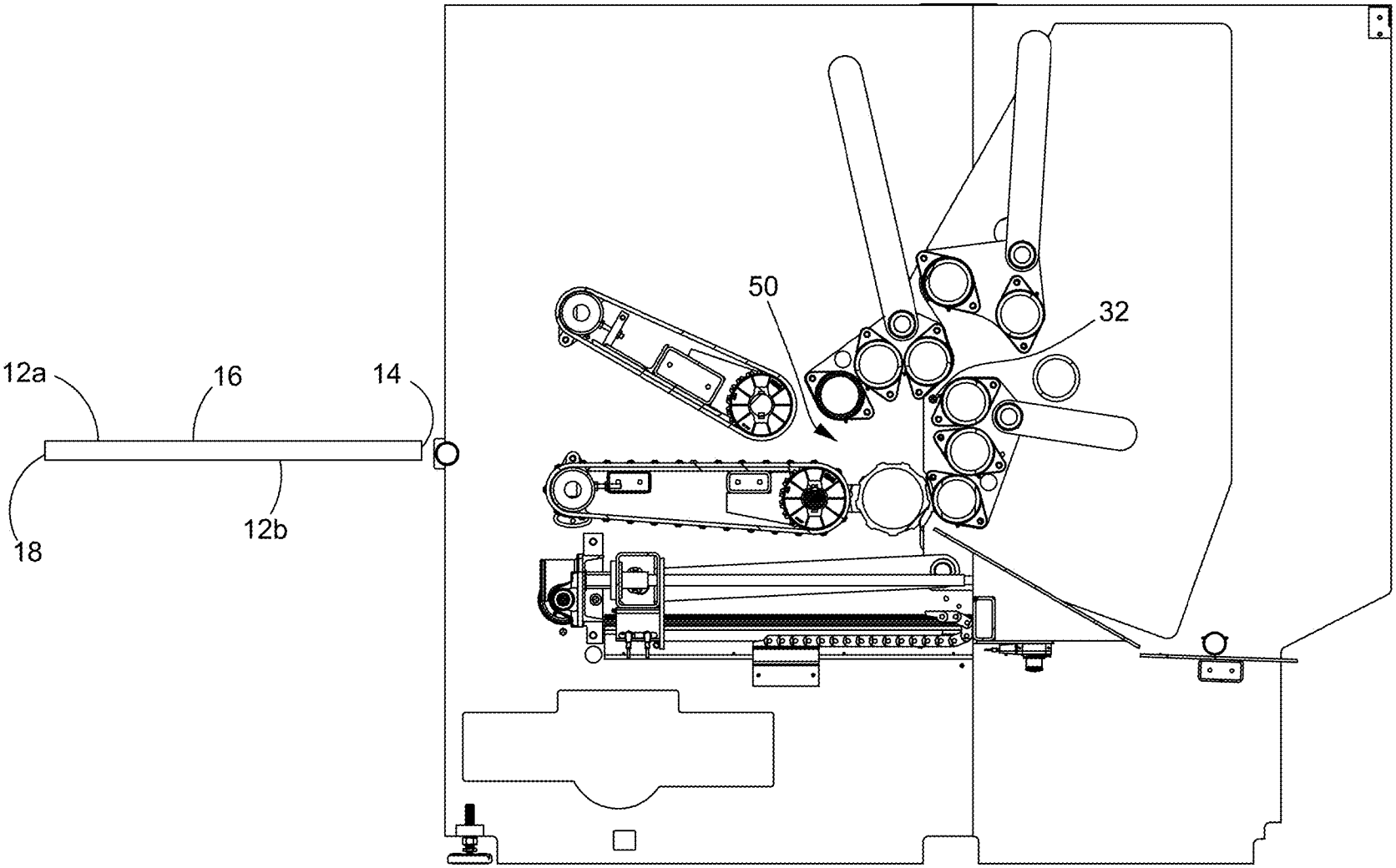
FIG. 13 is a cross-sectional schematic side view similar to that in FIG. 4, with the rollers in the first position and now showing the compressed material prior to entering the nip area upstream of the roll chamber.
Figure 14:
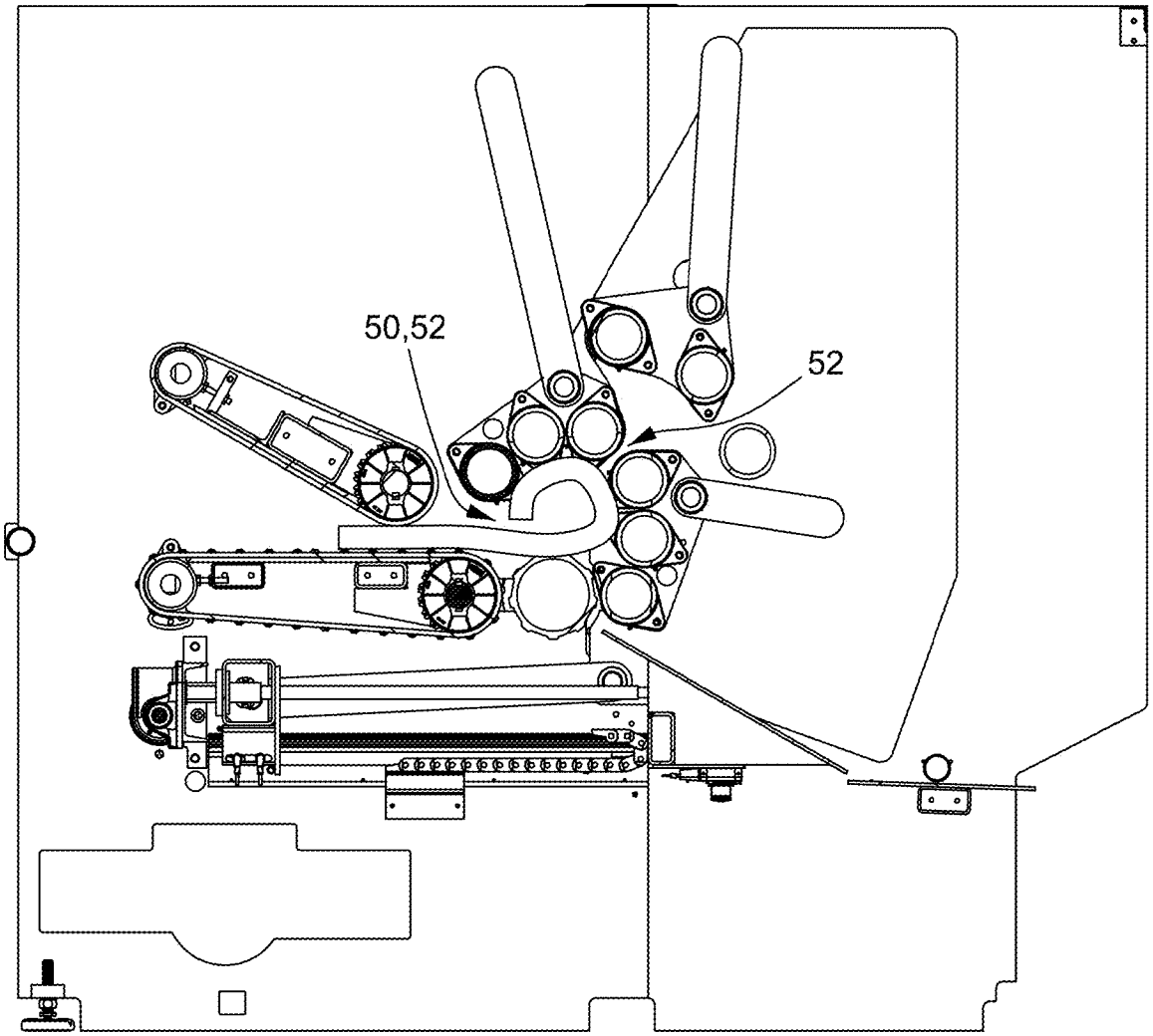
FIG. 14 is a cross-sectional schematic side view of that in FIG. 13, now showing the compressed material passing though the nip area and in the roll chamber and being rolled up through almost its first turn as the nose of the material is about to impact the middle portion of the material.
Figure 15:
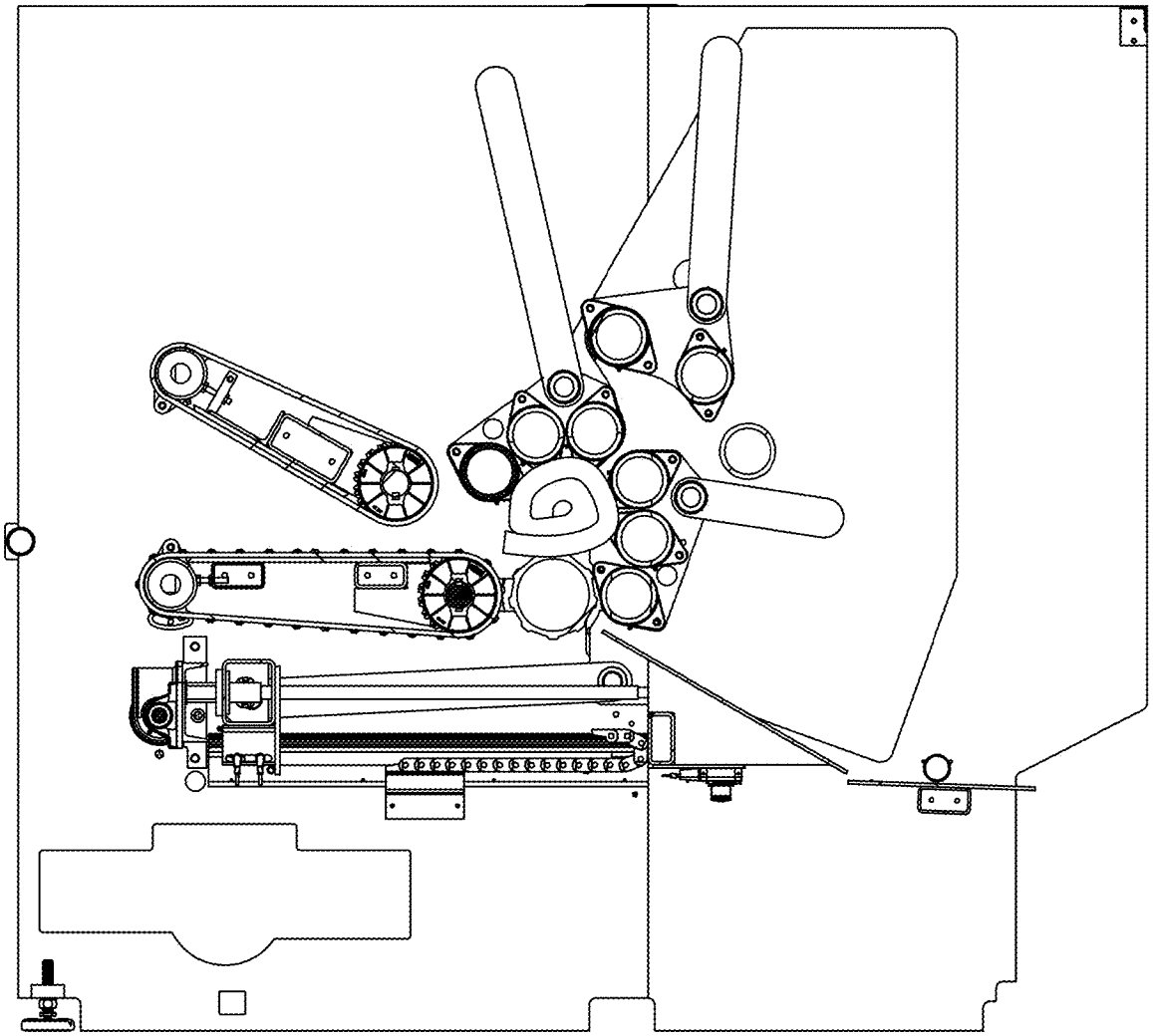
FIG. 15 is a cross-sectional schematic side view of that in FIG. 14, and now showing the compressed material in the roll chamber fully rolled up.

If the roll groups are maintained in their first position for the entire roll up process, as seen in FIGS. 13-15, then the material continues to be driven into the chamber 30 by the nip belts 22 until all material has passed through the nip area and is inside the chamber and rolling is complete. A wrap can be applied to the rolled up material in the chamber, like a pre-formed bag (not shown) that the roll is pushed into (not shown), or introducing a conventional stretch wrap material (not shown), to the nose or tail of the material 12 as it passes through the nip area 20, and then rolling the rolled up material several additional rotations to get a desired number of stretch wrap outer layers in place around the fully rolled up material. The stretch wrap outer layers will, substantially but not completely, hold the diameter of the rolled product to that achieved in the roll chamber, after the roll chamber goes to the open mode and the rolled material is ejected, as seen in FIGS. 20-21.

Alternatively, as described here and further below and in reference to FIGS. 16-18 in combination with FIG. 13, if the roll groups are not maintained in their first position for the entire roll up process, then a next step is moving one of the rollers in each of the two roll groups 40, 42, and preferably, moving a desired combination of the rollers in each group that are movable together. This means moving the movable roller(s) 40*a*, 42*a* away from the longitudinal central axis 32 independent of one other roller, 40*d*, 42*d*, in the roll groups 40, 42, respectively; and, also moving the movable roller(s) 40*a*, 40*b*, 42*a*, 42*b* from the first position to the final position, where the first position is located closer to the longitudinal central axis 32 than the final position is located to the longitudinal central axis. Such movement is exemplified in the positioning of the rollers going from the FIG. 13 configuration to that in FIG. 16, or going from the FIG. 17 configuration to that in FIG. 18, or going from the FIG. 18 configuration to that in FIG. 19, and various combinations of these. Finally, when practicing the process there is the step maintaining the two roll groups 40, 42 in the final position until the material 12 is completely inside the roll chamber 30 and finished rolling up. That is, when there is movement of the roll group(s) relative to the longitudinal central axis 32 as described herein, preferably it occurs for the final time when the nose of the material is well inside the roll chamber and the length of the material inside the chamber is anywhere from about 25% to 65% of the overall length of the material being rolled up in the chamber, more preferably when about 50% of the overall length of the material is inside the chamber, and most preferably no later than when the nose of the material impacts the middle portion 16 of the material still entering the roll chamber.

Figure 16:
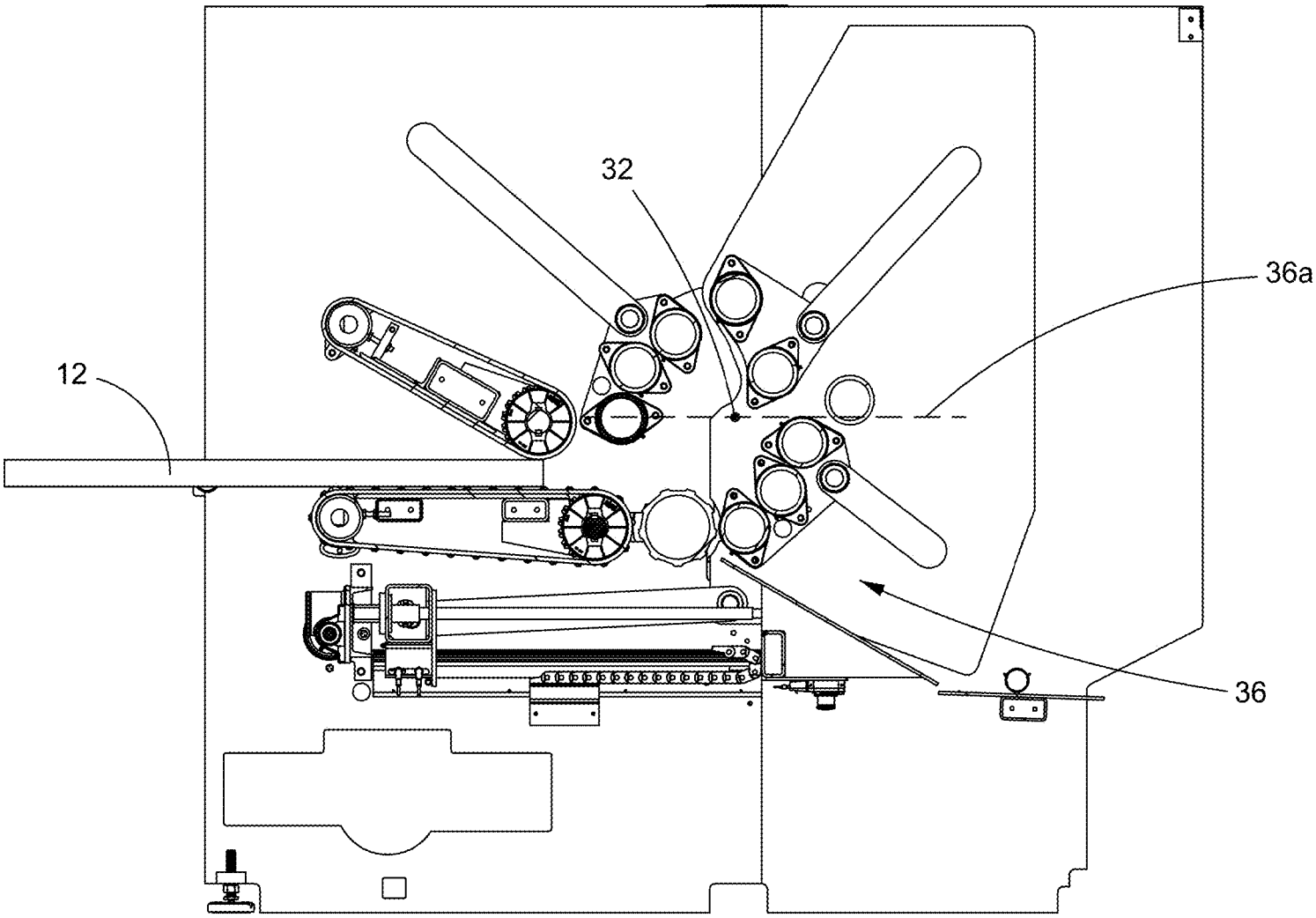
FIG. 16 is a cross-sectional schematic side view similar to that in FIG. 13, but with the rollers in the second position as the compressed material is in the nip area and begins to enter the nip and then be driven into the roll chamber.
Figure 17:
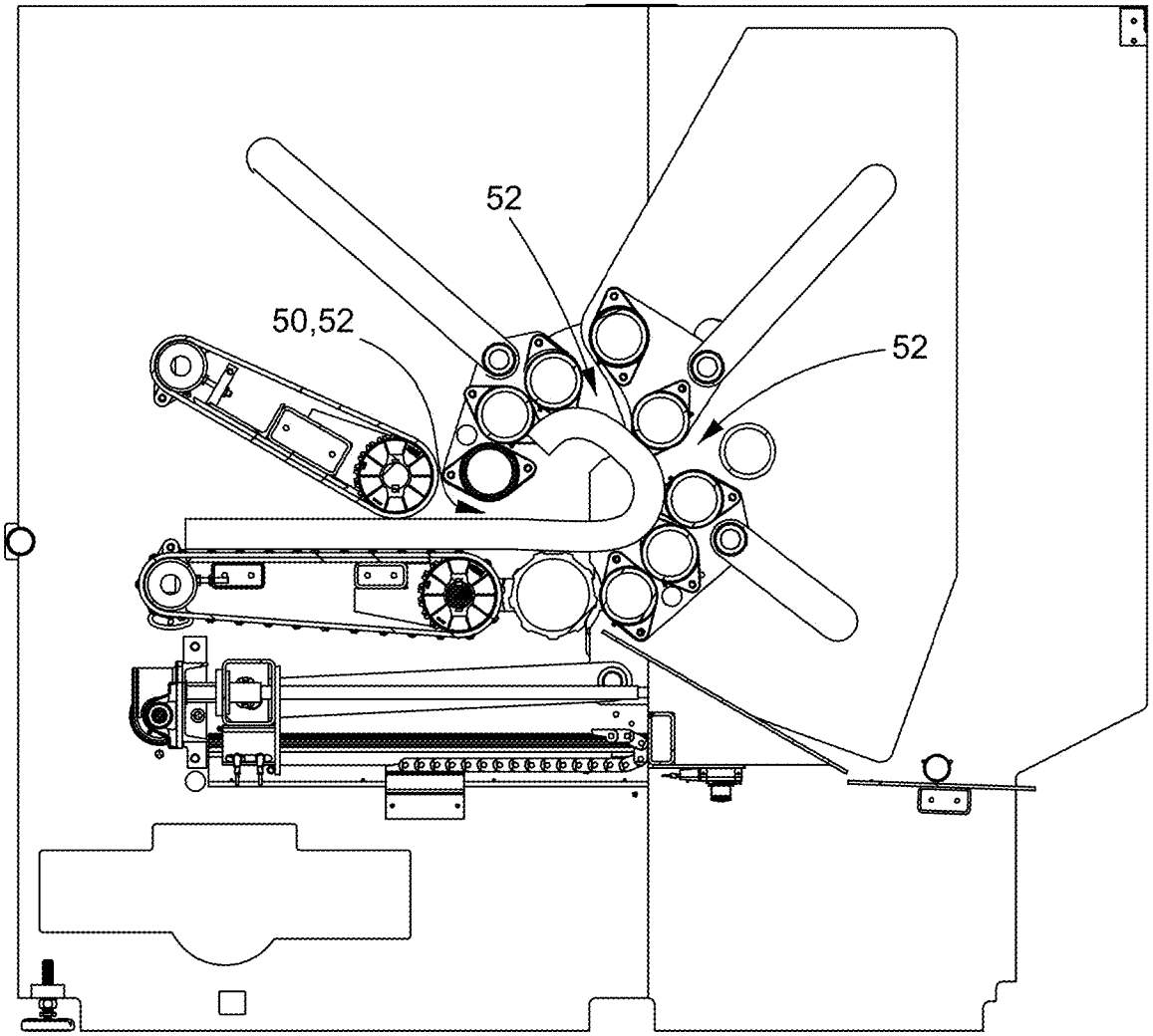
FIG. 17 is cross-sectional schematic side view similar to that in FIG. 16, with the rollers still in the second position as the compressed material is passing though the nip and into the roll chamber and being rolled up through almost its first turn as the nose of the material is about to impact the middle portion of the material.

Additionally, if desired, the process can include moving the two roll groups into a second position, after the first position and before the final position, such that the movable rollers are moved at a time that approximately coincides with the material entering the nip area (e.g., as the material 12 goes from FIG. 13 positioning to FIG. 16 positioning). In this way, the first position defines a first diameter of the roll chamber before the material enters the nip area upstream of the roll chamber (e.g., rollers as positioned in FIG. 13), the second position defines a second diameter of the roll chamber as the material enters the nip area (e.g., nose of material going from FIG. 13 positioning to FIG. 16 positioning and the rollers as positioned in FIG. 16), and the final position defines a third diameter of the roll chamber as the material continues to enter the roll chamber and the nose of the material is before it is about to impact the middle portion of the material entering the roll chamber (e.g., the rollers as positioned in FIG. 18). Further in this regard, for example, the second diameter (if applicable) is greater than the first diameter, and the third diameter is greater than the second diameter. And still further, as used and defined herein, the diameter of the roll chamber in the final position is greater than the diameter of the roll chamber in the first position. For clarity, if there are only the first position and the second position (thus the second position being the final position) of the movable roller(s), the process can include moving the two roll groups into the second/final position after the first position, such that the movable rollers are moved at a time when the nose of the material is well inside the roll chamber and the length of the material inside the chamber is anywhere from about 25% to 65% of the overall length of the material being rolled up in the chamber, more preferably when about 50% of the overall length of the material is inside the chamber, and most preferably no later than when the nose of the material impacts the middle portion of the material still entering the roll chamber (e.g., the material like in FIGS. 14 and 17 and the rollers then positioned to a greater diameter, like in FIG. 18 succeeding FIG. 17, and could be how the rollers are configured in FIG. 16 if that succeeds the FIG. 14 roller configuration).

While there are an infinite number of first, second (if applicable) and final positions, it is preferable that when the movable rollers move relative to the axis 32 they go to specific positions pre-determined as the first, the second, the second/final, and the final position. Even more preferably, when moving the movable roller(s) away from axis 32, if any portion of the material is in the roll chamber, movement of the roll group(s) most preferably occurs no later than when the nose of the material about to impact the middle portion of the material, as discussed earlier (e.g., the material like in FIGS. 14 and 17 and the rollers then positioned to a greater diameter, like in FIG. 18 succeeding FIG. 17, and could be how the rollers are configured in FIG. 16 if that succeeds the FIG. 14 roller configuration). Without being limited to a theory of understanding, the inventors have discovered such limited movement is preferred when dealing with compressed material, and especially when rolling high expansion force material like a compressed mattress. If movement occurs continuously or at other times in the roll up process when material is in the roll chamber, especially after the nose of the material impacts the middle portion of the material still entering the chamber, effectively managing pressure throughout the wind gets very difficult and even impossible, to the point where product will be damaged (internally and/or externally) and the machine can malfunction or break. Further in this regard, when the movable rollers move relative to the axis 32 they move to relatively quickly to such positions. As such, the movable rollers are preferably fixed in position relative to the axis 32 during most of the roll up time, preferably at least about 50% of the time and more preferably at least about 75% of the time, from the moment the nose 14 enters the roll chamber and until the material, including its tail 18, is completely rolled up including plastic or stretch wrapping and the rolled up material is ready to be ejected from the roll chamber. As such, preferably, the movable rollers do not move relative to the axis 32 throughout the rolling up of the material except to selectively move between the pre-determined positions.

Figure 6:
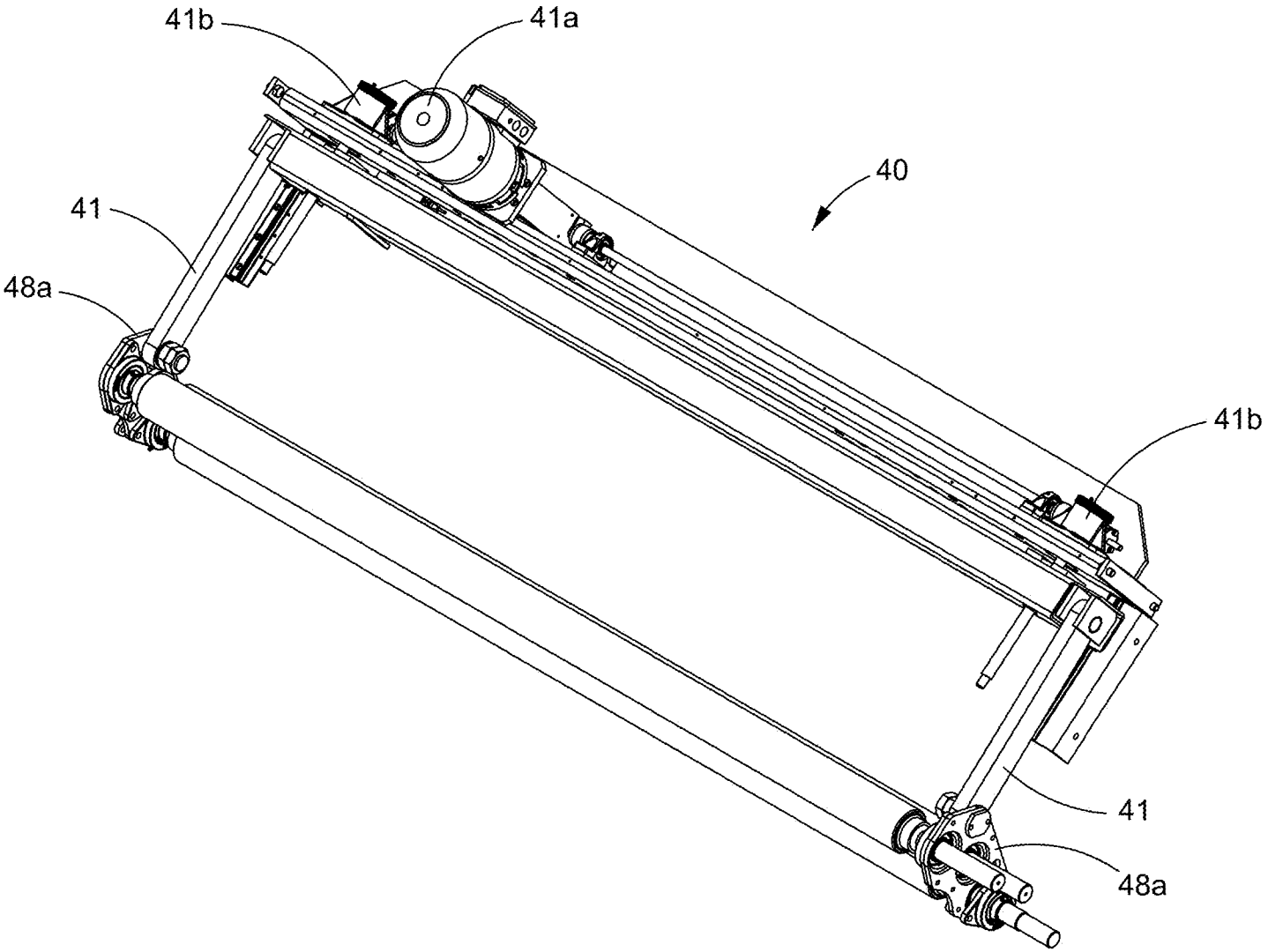
FIG. 6 is a perspective view of an alternate roll group of the plurality of rollers.
Figure 7:
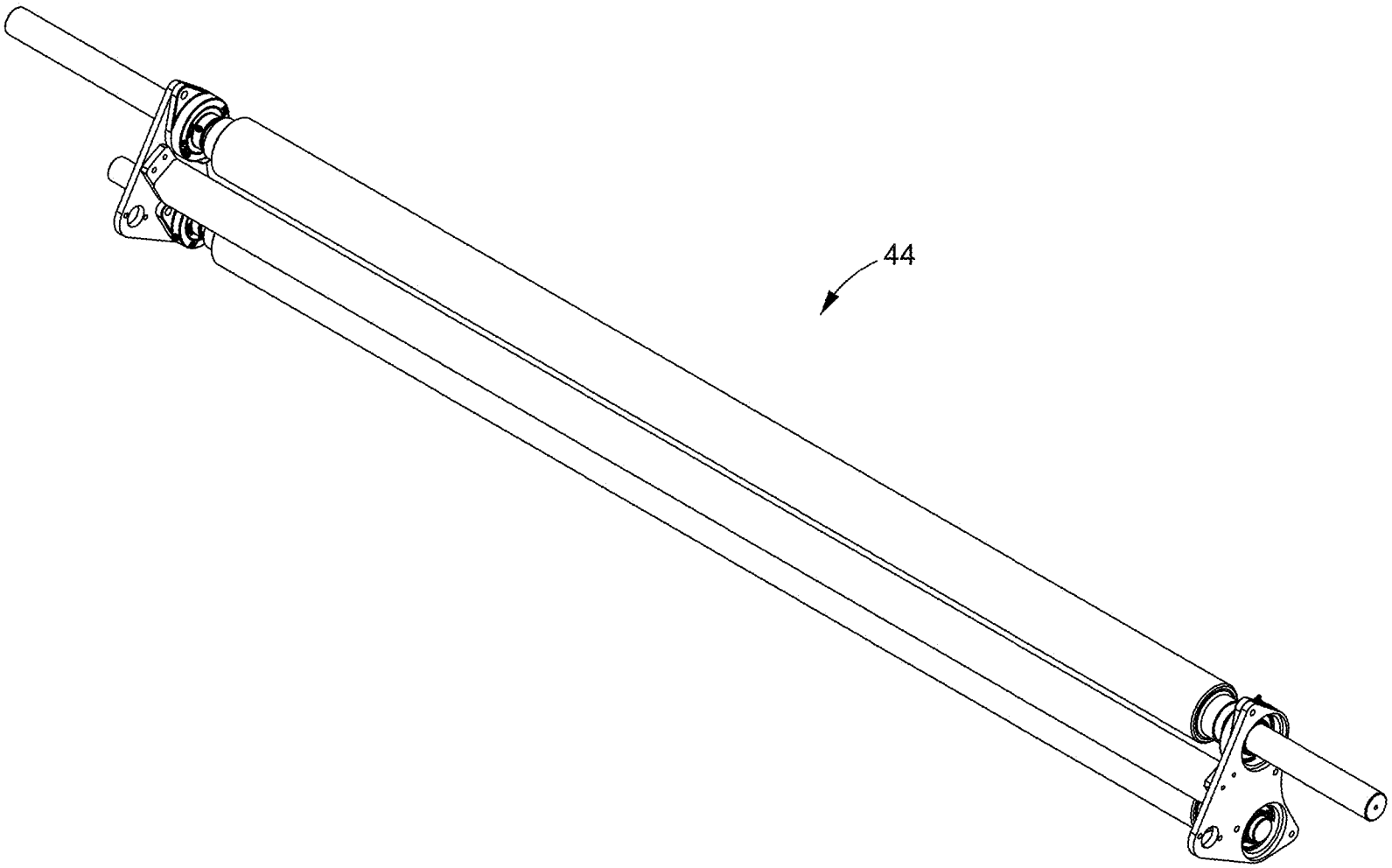
FIG. 7 is a perspective view of yet another roll group of the plurality of rollers.

Referring to FIGS. 2, 3, and 6, an exemplary way to move the movable rollers is depicted. The roll groups are mounted in the machine with movable supports (e.g., supports 48*a* in FIG. 6) and the supports to linkage arms (e.g., arms 41 in FIG. 6). The linkage arms are secured to the machine (now shown in detail) to be able to move the respective roll group axially in and out relative to the machine and the roll chamber formed by the plurality of rollers. Movement of the arms is controlled by a combination of motors (e.g., motors 41*a*, 43*a* and 45*a*, respectively) and ball screws (e.g., paired ball screws 41*b*, 43*b* and 45*b*, respectively). Based on the teachings herein, the motors are controlled as to when to operated and cause the ball screws to move the linkage arm toward or away from the longitudinal central axis 32. For example, when the plurality of rollers in the roll chamber can move to give the roll chamber a diameter between about 7 inches and about 16 inches, then at least two movement scenarios are possible. In the first scenario, if the fully rolled material desired diameter is less than about 11 inches, the pre-determine first position will be the smallest diameter of the of the roll chamber and the second/final position will be the desired fully rolled up product diameter (i.e., somewhere greater than the smallest diameter up to about 11, e.g., 8, 9, 10 or 11 inches or fractions of these). And, in the second scenario, if the fully rolled material desired diameter is greater than about 11 inches, the pre-determined first position will be the smallest diameter of the of the roll chamber, the pre-determined second position will be about 11 inches, and the final pre-determined position will be the desired fully rolled up product diameter (i.e., somewhere greater than 11 inches and up to the full diameter of the roll chamber, e.g., 11, 12, 13, 14, 15, 16 inches or fractions of these). As a further example, when the plurality of rollers in the roll chamber can move to give the roll chamber an even great than 16 inches diameter (or smaller than 7), then ratios based the just-discussed example the can be used to set the pre-determined first, second, second/final and final positions of the movable rollers. That is, if the fully rolled material desired diameter is less than or about 50% of the diameter range of the roll chamber, only first and second/final positions are used, with the first position being the smallest diameter of the roll chamber and the second/final position being the fully rolled material desired diameter. And relatedly, if the fully rolled material desired diameter is greater than 50% of the diameter range of the roll chamber, then the first, second and final positions are used, with the first position being the smallest diameter of the roll chamber, the second position about 40%-50% of the full diameter of the roll chamber, and the final position being the fully rolled material desired diameter.

Other aspects of the process are directed to the relationship of the rollers and functions of the same. For example, the process can include moving one of the rollers (40*a*, 42*a*, 44*a*) in each roll group (40, 42, 44) toward the longitudinal central axis 32 independent of one other roller (40*d*, 42*d*, 44*d*) in the roll group. Additionally or alternatively, can be the step fixing one of the rollers (40*d*, 42*d*, 44*d*) in each roll group (40, 42, 44) relative to the longitudinal central axis 32 and moving one of the rollers (40*a*, 42*a*, 44*a*) in each roll group toward or away from the longitudinal central axis. Still additionally or alternatively, can be the step fixing the longitudinal axis 36 of at least two of the rollers (40*a*/40*d*, 42*a*/40*d*, 44*a*/44*d*) in the roll groups (40, 42, 44) such that the rollers are fixed in position relative to each other (e.g., with movable supports 48*a*, 48*b*, 48*c*). Yet still additionally, or alternatively, can be the step moving one of the rollers (40*a*, 42*a*, 44*a*) in each of the two roll groups (40, 42, 44) away from the longitudinal central axis 32 independent of one other roll group (42, 44, 40).

As seen in FIGS. 1-7 are exemplary rollers in roller groups 40, 42 and 44. The rollers in each group are held in place relative to each other by supports 48*a*, 48*b* and 48*c*. The supports are mounted for pivoting movement about the longitudinal axes of their fixed rollers (40*d*, 42*d*, 44*d*) in the machine 10 to help define the roll chamber. Each support is driven by respective linkage arm 41, 43, 45 that is linked to a conventional motor 41*a*, 43*a*, and 45*a* placed around the outside of roll chamber 30. When moving, the movable the rollers 40*a*, 42*a*, 44*a* generally travel in arcuate movement paths 40*c*, 42*c*, 44*c* (as do rollers 40*b* and 42*b* when present, though the paths are not clearly visible) in all the Figures even though not depicted in some Figures. The length of the rollers can be up to about 8 feet long, and they are at least 1 foot long. FIG. 6 shows an exemplary linkage configuration, whereas FIGS. 5 and 7 just show the respective roll groups per se, and it is understood that similar appropriate linkage configurations could be employed.

Further in regards to the relationship of the rollers and functions of the same, the process can include providing one roller (44*a*, 44*d*, 54 and/or 55, and others (not shown)) independent of the two roll groups 40, 42 and locating the one roller around the circumference of the roll chamber positioned between the two roll groups. This step is preferred for reasons similar to those discussed in regards to machine 10. Additionally, or alternatively, there can be the step forming third roll group 44 comprising two rollers, as one roller independent of groups 40, 42, and moving one of the rollers (44*a*) in the third roll group toward or away from the longitudinal central axis 32 independent of one other roller (44*d*) in the third roll group. Alternatively, or additionally, the process can include the one roller independent of the two roll groups is lug roller 54, and preferably, locating the lug roller in the bottom portion 36 of the roll chamber. Related to this, even more preferably the process can include forming material infeed gap 50 in the circumference of the roll chamber and driving the material 12 through the infeed gap, and also, preferably locating the material infeed gap in the bottom portion 36 of the roll chamber, and even doing so adjacent the lug roller. Still further, the process can, additionally or alternatively, include powering the lug roller to provide at least 50% of a force needed to drive rolling up the material for the last 20% length of travel of the material entering the roll chamber.

Figure 8:
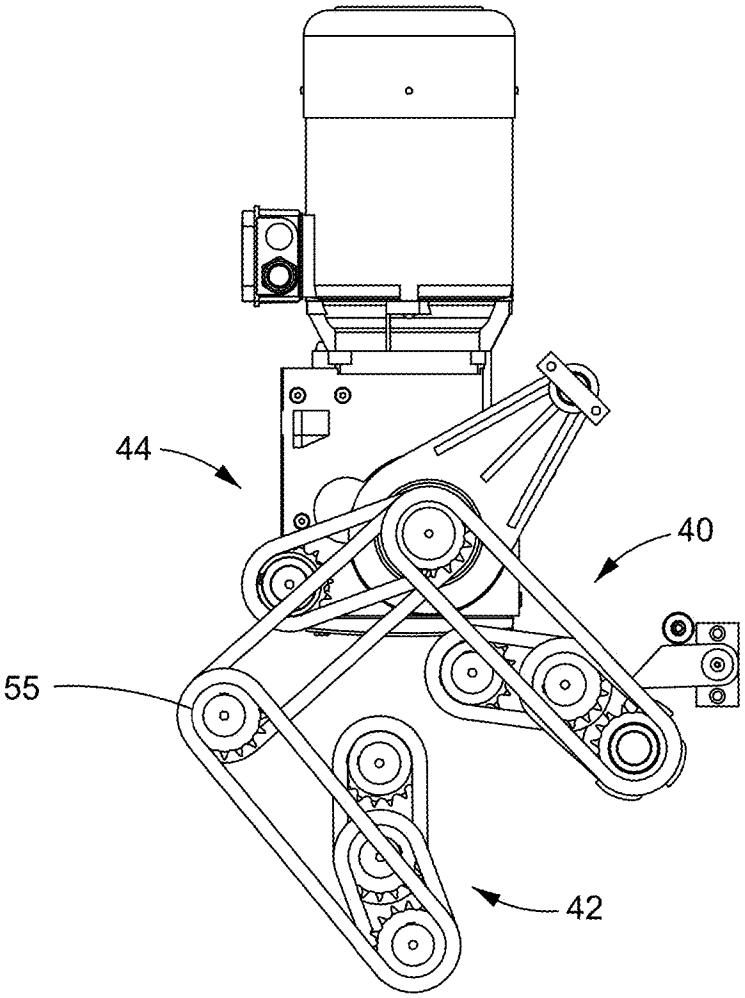
FIG. 8 is a side schematic view of the majority of the plurality of rollers in a belted configuration and a motor for driving the rolling of such rollers.
Figure 9:
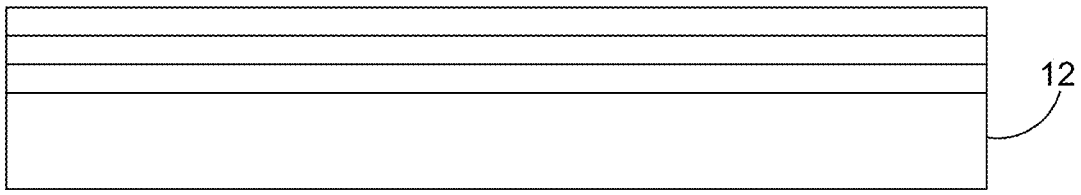
FIG. 9 is a side schematic view of a compressible material, like a mattress, having various layers of material, in its original uncompressed condition.
Figure 10:
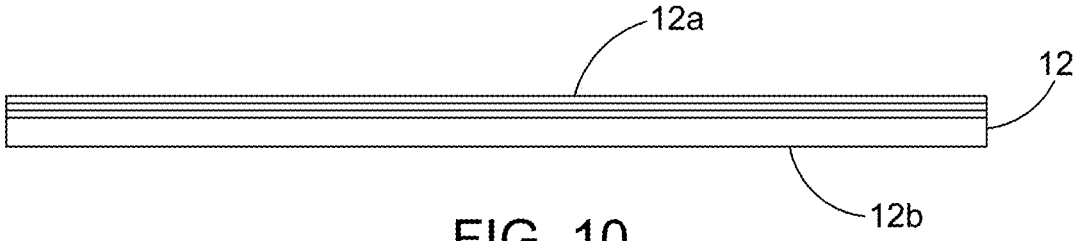
FIG. 10 is a side schematic view of that in FIG. 9, but now in substantially compressed condition.

Without being limited to a theory of understanding, the configuration of the roller(s) independent of the roll groups, and especially for the lug roller and location of same and the material infeed gap, such can take advantage of gravity and/or the natural tendency of the material being rolled up better during the roll up process. That is, locating the lug roller in bottom portion 36 puts the material above it, as well as adjacent to the gap in the circumference where the material is entering, and so as the material is rolled, gravity helps forces it downward onto the lug roller in combination with the rolling "up" and away from the material infeed gap 50. Further in this regard, and in reference to FIG. 8, preferably all rollers except the lug roller 54 are driven by one motor, and the lug roller is driven by its own motor 9 i.e., to aid in the lug roller providing the substantial driving force near the end of the roll up time). And additionally, preferably, roller 40*d* is not driven, it can only rotate in one direction (i.e., clockwise in FIG. 4), and it is only moved by the material in the roll chamber so this roller gives feedback to ensure the material is turning properly in the roll chamber. Still further, preferably, there is an angle 53 between lug roller 54 and roller 40*d* relative to the nip area, varied from about 8 degrees to about 30 degrees, and more preferably about 12 degrees to about 25 degrees, depending on the desired roll chamber size configuration. In operation, the rollers can, preferably, spin at a rate (of feet per minute) of 60 to 100, more preferably 80 to 100, and the material being rolled up is rotated at a rate of 60 to 100, and preferably 80 to 100, though other speeds are definitely possible, in combination with the teachings herein.

In other regards, additional preferred features of the roll chamber and its plurality of rollers can be employed. For example, rolling the plurality of rollers can include causing the nose 14 of the material to travel along the circumference of the roll chamber past three significant roller gaps 52 as the material continues to enter the roll chamber 30. A significant roller gap 52 is defined as any space between adjacent rollers that is at least two times greater than the smallest space between any two rollers' longitudinal axes fixed relative to each other. For example, the roller in roller groups 40 and 42 groups can be spaced apart from about one-eighth inch to about three-quarters of an inch, and preferably closer to about three-eighths of an inch, and the significant roller gap would be at least two times great than the smallest gap between the rollers in the roll groups. While not drawn to scale, but based on relative proportions, referring to the path the nose travels in FIG. 14, it only passes two significant roller gaps (first between roll groups 40 and 42, namely rollers 40*a* and 42*a*, and then the material infeed gap 50 between roll group 40 and lug roller 54). However, considering the path the nose travels in FIG. 17, it passes three significant roller gaps, and in FIG. 18 (if that is the roller positioning as the nose enters the roll chamber) it would be four significant roller gaps. Additionally, or alternatively, the process can include providing the roll chamber with three modes being the closed mode (FIGS. 4 and 13-18), the partially closed mode (FIG. 19) and the open mode (FIGS. 20-21), and each moving step is performed in the closed mode. This step is preferred for the same reasons stated earlier in regards to machine 10 and these three modes.

Based on feedback from the upstream equipment (not shown), the plurality of rollers can be moved to the pre-determined positions, as discussed herein. To determine the positions, information is gathered from the material in its pre-compressed condition, as well as its desired end package size and shape configuration. This information is fed into a Roll Cage Calculator ("the RCC") and its output used to identify and set the pre-determined positions that will produce an efficient and effective rolled up material, especially for a rolled up mattress product. The RCC uses basic geometric and math functions to arrive at the desired output. Set forth below in Table 1 is sample information to understand how the RCC operates.

TABLE 1

| Custom Mattress | Length | | Width | | Height | | Density | | Weight Per Layer | |
|---|---|---|---|---|---|---|---|---|---|---|
| Build | [in] | [mm] | [in] | [mm] | [in] | [mm] | [lb/ft^3] | [kg/m^3] | [lbs] | [kg] |
| Layer 1 | 80 | 2032 | 76 | 1930 | 12 | 305 | 3 | 48.06 | 126.67 | 57.45 |
| Layer 2 | 0 | 0 | 0 | 0 | 0 | 0 | 0 | 0.00 | 0.00 | 0.00 |
| Layer 3 | 0 | 0 | 0 | 0 | 0 | 0 | 0 | 0.00 | 0.00 | 0.00 |
| Layer 4 | 0 | 0 | 0 | 0 | 0 | 0 | 0 | 0.00 | 0.00 | 0.00 |
| Finished Size | 80 | 2032 | 76 | 1930 | 12 | 305 | | Total Weight | 126.67 | 57.45 |

| | Machine Values | | | Finished Product | | | |
|---|---|---|---|---|---|---|---|
| Parameters | Imperial | Metric | Expansion | Imperial | Metric | | |
| Diameter [in, mm] | 16 | 406.4 | 1.00 | 17.00 | 431.8 | | Enterable Values |
| Roll length [in, mm] | 40 | 1016.0 | | 40 | 1016.0 | | Calculated Value |
| Start Volume [ft3, m3] | 42.22 | 1.195 | | 42.22 | 1.195 | | Safe Value |
| End Volume [ft3, m3] | 4.65 | 0.132 | | 5.25 | 0.149 | | Safe Value |
| Volume change | 9.08 | 9.08 | <10 [Imperial] | 8.04 | 8.04 | <10 [Imperial] | |
| Start Density [lb/ft3, kg/m3] | 3.00 | 48.08 | | 3.00 | 48.08 | | |
| End Density [lb/ft3, kg/m3] | 27.23 | 436.43 | <30 [Imperial] | 24.12 | 386.59 | <25 [Imperial] | |

Figure 11:
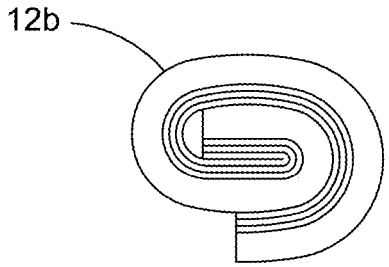
FIG. 11 is a side schematic view of that in FIG. 10 after it has been rolled up using the variable roll cage machine and process.
Figure 12:
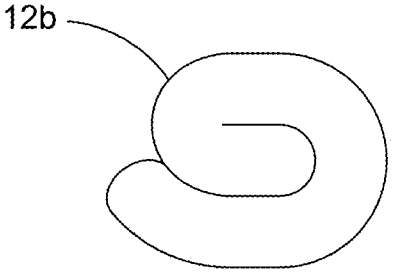
FIG. 12 is a side schematic view of that in FIG. 10 after it has been rolled up using the variable roll cage machine and process, first as a full length roll and then as a roll of a roll.

The first step to using the RCC is to measure the material to be rolled up and note its—Length, Width, Height and Weight, from which its Density can be calculated or if known that can be readily accepted. This is done for each layer of material of the to-be-rolled up material, e.g., a mattress, in the Custom Mattress Build area of Table 1. This is gathered from the pre-compressed material size and weight. Next is to identify the "Diameter" of the roll chamber 30 desired and note it in the Parameters section. In this example it is 16 inches, Imperial scale. Next, identify the desired "Roll length" of the mattress, i.e., the rolled up length of the fully rolled material once finished being rolled up in the roll chamber. Note, if the material is going to be rolled in its full length (e.g., 80 inches in this example), the "Roll length" value should mirror the desired finished size of the rolled up material (e.g., the FIG. 11 material rolled configuration). However, if the material is going to be rolled to less than its full length (e.g., 40 inches in this example, and as noted in the Roll length box of the Parameters for the Machine Values), the "Roll length" value should be half of the finished size of the rolled up material, as the upstream equipment folds the material in half before entry into the roll chamber (e.g., not shown but similar to FIG. 11 material rolled configuration if double onto itself).

Turning to the lower half of Table 1, next is to identify the "Expansion" value to indicate how much the material is expected to expand after being rolled up and with the plastic wrapping. Typically, this will be about 1.5 inches if using conventional plastic-like stretch material finished wrapped about three times around the fully rolled material and the stretch wrapped stretched to about 160% of its pre-wrapped length. In this example, it is 1 inch. This value is dependent on the nature of the material and the other factors described here like number of wrappings, expansion force of the rolled up material and End Density described below. Also, this is an estimated value to plan around, where the more wrappings of plastic wrap at the end of material roll up the smaller the expansion likely to occur. Next is calculating the "End Volume" as a function of the volume of the roll chamber that will be occupied by the rolled up material (i.e., the diameter of the roll chamber when the rollers are in their final position). That is, using the conventional formula to determine the volume of a cylinder ($v=\pi r^2 h$), then in this example where r=0.667 ft and h=3.334, End Volume is 4.65.

Next, is calculating the "Volume change" of the material from its pre-compressed condition (Start Volume 42.22 feet cubed in this example) to its volume when fully rolled up (End Volume 4.65 feet cubed in this example, as this is all the space it will get if we assume it completely enters the roll chamber) as a simple ratio, i.e. pre-compressed volume divided by fully rolled up volume to arrive at 9.08 in this example. Preferably the Volume change is in the range of 6 to 12, and more preferably about 8 to 10. Next is calculating the "End Density" (i.e., mass over volume) as a function of the "Start Density" (3.0 pounds per feet cubed in this example, the pre-compressed value) times the Volume change (9.08 in this example), to get 27.23 pounds per foot cubed in this example. Preferably the End Density in the machine through the end of rolling up is in the range of 20 to 35, and more preferably about 24 to 30. Preferably the End Density in the to-be package rolled up material (i.e., when in the final packaging and thus including the Expansion factor) is in the range of 20 to 30, and more preferably about 22 to 27. The "Diameter" of the Finished Product is the diameter of the final package, taking Expansion into account. It is calculated as the sum of the roll chamber Diameter and Expansion. Summarizing, the desired parameters here help better aid in the machine and the material not being damaged during roll up and the material maintaining more of the desired in use characteristics after packaging, shipping and then unpacking and use.

Using the above explanation, for added understanding of how to practice preferred aspects of the machine and/or process disclosed, several examples in paired sets are now discussed. The first table in each set identifies an undesirable situation because one or both of the Volume change and End Density for a particular roll chamber diameter could be harmful to the material being rolled up and/or the machine and process trying to do so. The second table in each set identifies an exemplary desirable situation because both of the Volume change and End Density for a particular roll chamber diameter will not be harmful to the material being rolled up and/or the machine and process trying to do so. When there are multiple layers, the Start Density is a weighted average of all the layers, and the other values and calculations are made in accordance with the teaching for Table 1.

In Table 2A, there is a 3 layer king size mattress folded in half and proposed to be rolled up at 9.5 inches for the roll chamber diameter in its final position. Shown in the Volume change and End Density numbers, this is not a desirable roll chamber diameter. Keeping everything constant but changing the roll chamber diameter to 13 inches for its final position, then in Table 2B a desirable result is produced as evidenced by the Volume change and End Density numbers in the preferred ranges.

TABLE 2A

| Custom Mattress | Length | | Width | | Height | | Density | | Weight Per Layer | |
|---|---|---|---|---|---|---|---|---|---|---|
| Build | [in] | [mm] | [in] | [mm] | [in] | [mm] | [lb/ft^3] | [kg/m^3] | [lbs] | [kg] |
| Layer 1 | 80 | 2032/76 | | 1930 | 6.0 | 152 | 1.80 | 28.83 | 38.00 | 17.24 |
| Layer 2 | 80 | 2032/76 | | 1930 | 1.0 | 25 | 2.00 | 32.04 | 7.04 | 3.19 |
| Layer 3 | 80 | 2032/76 | | 1930 | 2.0 | 51 | 3.00 | 48.06 | 21.11 | 9.58 |
| Layer 4 | 0 | 0 0 | | 0 | 0.0 | 0 | 0.00 | 0.00 | 0.00 | 0.00 |
| Finished Size | 80 | 2032/76 | | 1930 | 9 | 229 | | Total Weight | 66.15 | 30.00 |

| Primary Roll Cage | Machine Values | | | Finished Product | | |
|---|---|---|---|---|---|---|
| Parameters | Imperial | Metric | Expansion | Imperial | Metric | |
| Diameter [in, mm] | 9.5 | 241.3 | 1.00 | 10.50 | 266.7 | |
| Roll length [in, mm] | 40 | 1016 | | 40 | 1016 | |
| Start Volume [ft3, m3] | 31.67 | 0.896 | | 31.67 | 0.896 | |
| End Volume [ft3, m3] | 1.64 | 0.046 | | 2.00 | 0.057 | |
| Volume change | 19.31 | 19.31 | <10 [Imperial] | 15.81 | 15.81 | <10 [Imperial] |
| Start Density [lb/ft3, kg/m3] | 2.09 | 33.48 | | 2.09 | 33.48 | |
| End Density [lb/ft3, kg/m3] | 40.34 | 646.49 | <30 [Imperial] | 33.02 | 529.21 | <25 [Imperial] |

TABLE 2B

| Custom Mattress | Length | | Width | | Height | | Density | | Weight Per Layer | |
|---|---|---|---|---|---|---|---|---|---|---|
| Build | [in] | [mm] | [in] | [mm] | [in] | [mm] | [lb/ft^3] | [kg/m^3] | [lbs] | [kg] |
| Layer 1 | 80 | 2032 | 76 | 1930 | 6.0 | 152 | 1.80 | 28.83 | 38.00 | 17.24 |
| Layer 2 | 80 | 2032 | 76 | 1930 | 1.0 | 25 | 2.00 | 32.04 | 7.04 | 3.19 |
| Layer 3 | 80 | 2032 | 76 | 1930 | 2.0 | 51 | 3.00 | 48.06 | 21.11 | 9.58 |
| Layer 4 | 0 | 0 | 0 | 0 | 0.0 | 0 | 0.00 | 0.00 | 0.00 | 0.00 |
| Finished Size | 80 | 2032 | 76 | 1930 | 9 | 229 | | Total Weight | 66.15 | 30.00 |

| Primary Roll Cage | Machine Values | | | Finished Product | | |
|---|---|---|---|---|---|---|
| Parameters | Imperial | Metric | Expansion | Imperial | Metric | |
| Diameter [in, mm] | 13 | 330.2 | 1.00 | 14.00 | 355.6 | |
| Roll length [in, mm] | 40 | 1016 | | 40 | 1016 | |
| Start Volume [ft3, m3] | 31.67 | 0.896 | | 31.67 | 0.896 | |
| End Volume [ft3, m3] | 3.07 | 0.087 | | 3.56 | 0.101 | |
| Volume change | 10.31 | 10.31 | <10 [Imperial] | 8.89 | 8.89 | <10 [Imperial] |
| Start Density [lb/ft3, kg/m3] | 2.09 | 33.48 | | 2.09 | 33.48 | |
| End Density [lb/ft3, kg/m3] | 21.54 | 345.24 | <30 [Imperial] | 18.57 | 297.68 | <25 [Imperial] |

In Table 3A, there is a 4 layer queen size mattress folded in half and proposed to be rolled up at 8.5 inches for the roll chamber diameter in its final position. Shown in the Volume change and End Density numbers, this is not a desirable roll chamber diameter. Keeping everything constant but changing the roll chamber diameter to 12 inches for its final position, then in Table 3B a desirable result is produced as evidenced by the Volume change and End Density numbers in the preferred ranges.

TABLE 3A

| Custom Mattress | Length | | Width | | Height | | Density | | Weight Per Layer | |
|---|---|---|---|---|---|---|---|---|---|---|
| Build | [in] | [mm] | [in] | [mm] | [in] | [mm] | [lb/ft^3] | [kg/m^3] | [lbs] | [kg] |
| Layer 1 | 80 | 2032 | 60 | 1524 | 6.0 | 152 | 1.80 | 28.83 | 30.00 | 13.61 |
| Layer 2 | 80 | 2032 | 60 | 1524 | 3.0 | 76 | 2.00 | 32.04 | 16.67 | 7.56 |
| Layer 3 | 80 | 2032 | 60 | 1524 | 2.0 | 51 | 3.00 | 48.06 | 16.67 | 7.56 |
| Layer 4 | 80 | 2032 | 60 | 1524 | 1.0 | 25 | 4.00 | 64.07 | 11.11 | 5.04 |
| Finished Size | 80 | 2032 | 60 | 1524 | 12 | 305 | | Total Weight | 74.44 | 33.77 |

| Primary Roll Cage | Machine Values | | | Finished Product | |
|---|---|---|---|---|---|
| Parameters | Imperial | Metric | Expansion | Imperial | Metric |
| Diameter [in, mm] | 8.5 | 215.9 | 1.00 | 9.50 | 241.3 |
| Roll length [in, mm] | 40 | 1016 | | 40 | 1016 |
| Start Volume [ft3, m3] | 33.33 | 0.943 | | 33.33 | 0.943 |
| End Volume [ft3, m3] | 1.31 | 0.037 | | 1.64 | 0.046 |

TABLE 3A-continued

| | | | | | | |
|---|---|---|---|---|---|---|
| Volume change | 25.39 | 25.39 | <10 [Imperial] | 20.33 | 20.33 | <10 [Imperial] |
| Start Density [lb/ft3, kg/m3] | 2.23 | 35.80 | | 2.23 | 35.80 | |
| End Density [lb/ft3, kg/m3] | 56.70 | 908.84 | <30 [Imperial] | 45.39 | 727.57 | <25 [Imperial] |

TABLE 3B

| Custom Mattress | Length | | Width | | Height | | Density | | Weight Per Layer | |
|---|---|---|---|---|---|---|---|---|---|---|
| Build | [in] | [mm] | [in] | [mm] | [in] | [mm] | [lb/ft^3] | [kg/m^3] | [lbs] | [kg] |
| Layer 1 | 80 | 2032 | 60 | 1524 | 6.0 | 152 | 1.80 | 28.83 | 30.00 | 13.61 |
| Layer 2 | 80 | 2032 | 60 | 1524 | 3.0 | 76 | 2.00 | 32.04 | 16.67 | 7.56 |
| Layer 3 | 80 | 2032 | 60 | 1524 | 2.0 | 51 | 3.00 | 48.06 | 16.67 | 7.56 |
| Layer 4 | 80 | 2032 | 60 | 1524 | 1.0 | 25 | 4.00 | 64.07 | 11.11 | 5.04 |
| Finished Size | 80 | 2032 | 60 | 1524 | 12 | 305 | | Total Weight | 74.44 | 33.77 |

| Primary Roll Cage | Machine Values | | | Finished Product | | |
|---|---|---|---|---|---|---|
| Parameters | Imperial | Metric | Expansion | Imperial | Metric | |
| Diameter [in, mm] | 12 | 304.8 | 1.00 | 13.00 | 330.2 | |
| Roll length [in, mm] | 40 | 1016 | | 40 | 1016 | |
| Start Volume [ft3, m3] | 33.33 | 0.943 | | 33.33 | 0.943 | |
| End Volume [ft3, m3] | 2.62 | 0.074 | | 3.07 | 0.087 | |
| Volume change | 12.74 | 12.74 | <10 [Imperial] | 10.85 | 10.85 | <10 [Imperial] |
| Start Density [lb/ft3, kg/m3] | 2.23 | 35.80 | | 2.23 | 35.80 | |
| End Density [lb/ft3, kg/m3] | 28.45 | 456.00 | <30 [Imperial] | 24.24 | 388.54 | <25 [Imperial] |

In Table 4A, there is a 4 layer queen size mattress (15 inch height) folded in half and proposed to be rolled up at 11 inches for the roll chamber diameter in its final position. Shown in the Volume change and End Density numbers, this is not a desirable roll chamber diameter. Keeping everything constant but changing the roll chamber diameter to 14 inches for its final position, then in Table 4B a still desirable result is produced as evidenced by the Volume change and End Density numbers in the preferred ranges.

TABLE 4A

| Custom Mattress | Length | | Width | | Height | | Density | | Weight Per Layer | |
|---|---|---|---|---|---|---|---|---|---|---|
| Build | [in] | [mm] | [in] | [mm] | [in] | [mm] | [lb/ft^3] | [kg/m^3] | [lbs] | [kg] |
| Layer 1 | 80 | 2032 | 60 | 1524 | 6.0 | 152 | 1.80 | 28.83 | 30.00 | 13.61 |
| Layer 2 | 80 | 2032 | 60 | 1524 | 4.0 | 102 | 1.80 | 28.83 | 20.00 | 9.07 |
| Layer 3 | 80 | 2032 | 60 | 1524 | 3.0 | 76 | 3.00 | 48.06 | 25.00 | 11.34 |
| Layer 4 | 80 | 2032 | 60 | 1524 | 2.0 | 51 | 4.00 | 64.07 | 22.22 | 10.08 |
| Finished Size | 80 | 2032 | 60 | 1524 | 15 | 381 | | Total Weight | 97.22 | 44.10 |

TABLE 4A-continued

| Primary Roll Cage | Machine Values | | | Finished Product | | |
|---|---|---|---|---|---|---|
| Parameters | Imperial | Metric | Expansion | Imperial | Metric | |
| Diameter [in, mm] | 11 | 279.4 | 1.00 | 12.00 | 304.8 | |
| Roll length [in, mm] | 40 | 1016 | | 40 | 1016 | |
| Start Volume [ft3, m3] | 41.67 | 1.179 | | 41.67 | 1.179 | |
| End Volume [ft3, m3] | 2.20 | 0.062 | | 2.62 | 0.074 | |
| Volume change | 18.95 | 18.95 | <10 [Imperial] | 15.92 | 15.92 | <10 [Imperial] |
| Start Density [lb/ft3, kg/m3] | 2.33 | 37.40 | | 2.33 | 37.40 | |
| End Density [lb/ft3, kg/m3] | 44.22 | 708.71 | <30 [Imperial] | 37.15 | 595.52 | <25 [Imperial] |

TABLE 4B

| Custom Mattress | Length | | Width | | Height | | Density | | Weight Per Layer | |
|---|---|---|---|---|---|---|---|---|---|---|
| Build | [in] | [mm] | [in] | [mm] | [in] | [mm] | [lb/ft^3] | [kg/m^3] | [lbs] | [kg] |
| Layer 1 | 80 | 2032 | 60 | 1524 | 6.0 | 152 | 1.80 | 28.83 | 30.00 | 13.61 |
| Layer 2 | 80 | 2032 | 60 | 1524 | 4.0 | 102 | 1.80 | 28.83 | 20.00 | 9.07 |
| Layer 3 | 80 | 2032 | 60 | 1524 | 3.0 | 76 | 3.00 | 48.06 | 25.00 | 11.34 |
| Layer 4 | 80 | 2032 | 60 | 1524 | 2.0 | 51 | 4.00 | 64.07 | 22.22 | 10.08 |
| Finished Size | 80 | 2032 | 60 | 1524 | 15 | 381 | | Total Weight | 97.22 | 44.10 |

| Primary Roll Cage | Machine Values | | | Finished Product | | |
|---|---|---|---|---|---|---|
| Parameters | Imperial | Metric | Expansion | Imperial | Metric | |
| Diameter [in, mm] | 14 | 355.6 | 1.00 | 15.00 | 381 | |
| Roll length [in, mm] | 40 | 1016 | | 40 | 1016 | |
| Start Volume [ft3, m3] | 41.67 | 1.179 | | 41.67 | 1.179 | |
| End Volume [ft3, m3] | 3.56 | 0.101 | | 4.09 | 0.116 | |
| Volume change | 11.70 | 11.70 | <10 [Imperial] | 10.19 | 10.19 | <10 [Imperial] |
| Start Density [lb/ft3, kg/m3] | 2.33 | 37.40 | | 2.33 | 37.40 | |
| End Density [lb/ft3, kg/m3] | 27.30 | 437.52 | <30 [Imperial] | 23.78 | 381.13 | <25 [Imperial] |

Additional discussion of embodiments in various scopes now follows:

A. A variable roll cage machine to roll up compressed high expansion force material. The machine includes a roll chamber to receive the material. The roll chamber has a longitudinal central axis and a plurality of rollers located around a circumference of the roll chamber. The plurality of rollers include two roll groups. Each roll group includes two rollers. One of the rollers in each roll group is movable toward the longitudinal central axis independent of one other roller in the roll group. Two of the rollers in each roll group have a longitudinal axis and the longitudinal axes of the two rollers in each roll group are fixed relative to each other. A material infeed gap is in the circumference of the roll chamber located between the two roll groups and spaced from the one of the rollers that is movable in each roll group.

B. A variable roll cage machine to roll up material. The machine includes a roll chamber to receive the material. The roll chamber is beltless and has a longitudinal central axis and a plurality of rollers located around a circumference of the roll chamber. The plurality of rollers include two roll groups. Each roll group includes two rollers. One of the rollers in each roll group is movable toward the longitudinal central axis independent of one other roller in the roll group. The roll chamber includes a material infeed gap in the circumference of the roll chamber located between the two roll groups and spaced from one of the rollers that is movable in each roll group.

C. The machine according to embodiment A, wherein the roll chamber is beltless.

D. The machine according to any of the prior machine embodiments here, wherein one of the rollers in each of the two roll groups being movable away from the longitudinal central axis independent of one other roller in the roll group.

E. The machine according to any of the prior machine embodiments here, wherein one of the rollers in each roll group being fixed relative to the longitudinal central axis when the one of the rollers in each roll group is movable toward the longitudinal central axis.

F. The machine according to any of the prior machine embodiments here, wherein the longitudinal axes of the rollers being fixed relative to each other comprises the rollers being secured in a movable support.

G. The machine according to any of the prior machine embodiments here, wherein the two roll groups comprise one roller in each roll group that is movable toward and away from the longitudinal central axis independent of one roller in another roll group.

H. The machine according to any of the prior machine embodiments here, wherein the roll chamber has three modes comprising a closed mode, a partially closed mode and an open mode, and the one of the rollers in each roll group being movable is possible in the closed mode.

I. The machine according to any of the prior machine embodiments here, wherein one roller is independent of the two roll groups and located around the circumference of the roll chamber and positioned between the two roll groups.

J. The machine according to any of the prior machine embodiments here, wherein one roller independent of the two roll groups comprises two rollers forming a third roll group.

K. The machine according to any of the prior machine embodiments here, wherein one roller independent of the two roll groups comprises a lug roller.

L. The machine according to any of the prior machine embodiments here, wherein the lug roller is located in a bottom portion of the roll chamber.

M. The machine according to any of the prior machine embodiments here, wherein the material infeed gap is located in a bottom portion of the roll chamber.

N. The machine according to any of the prior machine embodiments here, wherein the lug roller is located adjacent to the material infeed gap.

O. The machine according to any of the prior machine embodiments here, wherein the roll chamber has three modes comprising a closed mode, a partially closed mode and an open mode, and the two roll groups are spaced from each other a first distance in the closed mode and a second distance in the partially closed mode, and the second distance is greater than the first distance.

P. A process for rolling up compressed high expansion force material. One step is forming a roll chamber. The roll chamber has a longitudinal central axis and a plurality of rollers located around a circumference of the roll chamber. Next is forming the plurality of rollers into two roll groups, each roll group including two rollers. Then, driving the material into the roll chamber against at least one of the plurality of rollers. And another step is rolling the plurality of rollers to cause the nose of the material to travel along the circumference of the roll chamber as material continues to enter the roll chamber. Followed by the step moving one of the rollers in each of the two roll groups. In this step, moving one of the rollers away from the longitudinal central axis independent of one other roller in the roll group. And also, moving one of the rollers from a first position to a final position, where the first position is located closer to the longitudinal central axis than the final position is located to the longitudinal central axis. And a final step is maintaining the two roll groups in the final position until the material is completely inside the roll chamber and finished rolling up.

Q. A process for rolling up material. The process includes various steps, as follows. One step is forming a roll chamber. The roll chamber has a longitudinal central axis and a plurality of rollers located around a circumference of the roll chamber. A next step is forming the plurality of rollers into two roll groups, each roll group including two rollers. And then, the step moving the two roll groups into a pre-determined first position defining a first diameter of the roll chamber before the material enters a nip area upstream of the roll chamber. And, step driving the material toward the roll chamber. Followed by moving the two roll groups into a pre-determined second position defining a second diameter of the roll chamber as the material enters the nip area, with the second diameter being greater than the first diameter. Another step is driving a nose of the material into the roll chamber and against at least one of the plurality of rollers. Next, is step rolling the plurality of rollers to cause the nose of the material to travel along the circumference of the roll chamber as material continues to enter the roll chamber. And another step is, moving the two roll groups into a pre-determined final position defining a third diameter of the roll chamber as the material continues to enter the roll chamber and before the nose of the material is about to impact a middle portion of the material entering the roll chamber, with the third diameter being greater than the second diameter. And a further step is maintaining the two roll groups in the pre-determined final position until the material is completely inside the roll chamber and finished rolling up.

R. The process according to any of the prior process embodiments here, further comprising moving one of the rollers in each roll group toward the longitudinal central axis independent of one other roller in the roll group.

S. The process according to any of the prior process embodiments here, wherein driving the nose of the material comprises impacting one of the plurality of rollers in a bottom portion of the roll chamber.

T. The process according to any of the prior process embodiments here, further comprising forming a material infeed gap between the two roll groups.

U. The process according to any of the prior process embodiments here, wherein forming comprises locating the material infeed gap in a bottom portion of the roll chamber.

V. The process according to any of the prior process embodiments here, wherein rolling the plurality of rollers comprises causing the nose of the material to travel up along the circumference of the roll chamber as material continues to enter the roll chamber.

W. The process according to any of the prior process embodiments here, further comprising the plurality of rollers directly rolling against the material to roll up the material.

X. The process according to any of the prior process embodiments here, further comprising fixing the longitudinal axis of at least two of the rollers in the two roll groups such that the rollers are fixed in position relative to each other.

Y. The process according to any of the prior process embodiments here, further comprising moving one of the rollers in each of the two roll groups away from the longitudinal central axis independent of one other roll group.

Z. The process according to any of the prior process embodiments here, further comprising fixing one of the rollers in each roll group relative to the longitudinal central axis and moving one of the rollers in each roll group toward or away from the longitudinal central axis.

AA. The process according to any of the prior process embodiments here, further comprising providing the roll chamber with three modes being a closed mode, a partially closed mode and an open mode, and each moving step comprises doing so in the closed mode.

BB. The process according to any of the prior process embodiments here, further comprising providing one roller independent of the two roll groups and locating the one roller around the circumference of the roll chamber positioned between the two roll groups.

CC. The process according to any of the prior process embodiments here, further comprising forming a third roll group comprising two rollers.

DD. The process according to any of the prior process embodiments here, further comprising moving one of the rollers in the third roll group toward or away from the longitudinal central axis independent of one other roller in the third roll group.

EE. The process according to any of the prior process embodiments here, wherein the one roller independent of the two roll groups comprises a lug roller.

FF. The process according to any of the prior process embodiments here, further comprising locating the lug roller in a bottom portion of the roll chamber.

GG. The process according to any of the prior process embodiments here, wherein driving the material into the roll chamber is further comprising forming a material infeed gap in the circumference of the roll chamber and driving the material through the material infeed gap.

HH. The process according to any of the prior process embodiments here, further comprising locating a lug roller adjacent to the material infeed gap and powering the lug roller to provide at least 50% of a force needed to drive rolling up the material for the last 20% length of travel of the material entering the roll chamber.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the packaging arts, and all such modifications and other embodiments are intended and deemed to be within the scope of the invention.

What is claimed is:

1. A variable roll cage machine to roll up compressed high expansion force material comprising:

a roll chamber to receive the material, the roll chamber having a longitudinal central axis and comprising a plurality of rollers located around a circumference of the roll chamber;

the plurality of rollers comprising two roll groups, each roll group comprising two rollers;

one of the rollers in each roll group being movable toward the longitudinal central axis independent of one other roller in the roll group;

two of the rollers in each roll group having a longitudinal axis and the longitudinal axes of the two rollers in each roll group being fixed relative to each other; and, a material infeed gap in the circumference of the roll chamber located between the two roll groups and spaced from the one of the rollers that is movable in each roll group.

2. The machine of claim 1, wherein the roll chamber is beltless.

3. The machine of claim 1, further comprising one of the rollers in each of the two roll groups being movable away from the longitudinal central axis independent of one other roller in the roll group.

4. The machine of claim 1, wherein one of the rollers in each roll group being fixed relative to the longitudinal central axis when the one of the rollers in each roll group is movable toward the longitudinal central axis.

5. The machine of claim 1, wherein the longitudinal axes of the rollers being fixed relative to each other comprises the rollers being secured in a movable support.

6. The machine of claim 1, wherein the two roll groups comprise one roller in each roll group that is movable toward and away from the longitudinal central axis independent of one roller in another roll group.

7. The machine of claim 1, wherein the roll chamber has three modes comprising a closed mode, a partially closed mode and an open mode, and the one of the rollers in each roll group being movable toward the longitudinal central axis independent of one other roller in the roll group is possible in the closed mode.

8. The machine of claim 1, further comprising one roller independent of the two roll groups and located around the circumference of the roll chamber and positioned between the two roll groups.

9. The machine of claim 8, wherein one roller independent of the two roll groups comprises two rollers forming a third roll group.

10. The machine of claim 9, wherein one of the rollers in the third roll group being movable toward the longitudinal central axis independent of one other roller in the third roll group.

11. The machine of claim 8, wherein one roller independent of the two roll groups comprises a lug roller.

12. The machine of claim 11, wherein the lug roller is located in a bottom portion of the roll chamber.

13. The machine of claim 1, wherein the material infeed gap is located in a bottom portion of the roll chamber.

14. The machine of claim 11, further comprising the lug roller is located adjacent to the material infeed gap.

15. The machine of claim 1, wherein the roll chamber has three modes comprising a closed mode, a partially closed mode and an open mode, and the two roll groups are spaced from each other a first distance in the closed mode and a second distance in the partially closed mode, and the second distance is greater than the first distance.

16. A process for rolling up material comprising:

forming a roll chamber, the roll chamber having a longitudinal central axis and comprising a plurality of rollers located around a circumference of the roll chamber;

forming the plurality of rollers into two roll groups, each roll group comprising two rollers;

moving the two roll groups into a pre-determined first position defining a first diameter of the roll chamber before the material enters a nip area upstream of the roll chamber;

driving the material toward the roll chamber;

moving the two roll groups into a pre-determined second position defining a second diameter of the roll chamber as the material enters the nip area, with the second diameter being greater than the first diameter;

driving a nose of the material into the roll chamber and against at least one of the plurality of rollers;

rolling the plurality of rollers to cause the nose of the material to travel along the circumference of the roll chamber as material continues to enter the roll chamber;

moving the two roll groups into a pre-determined final position defining a third diameter of the roll chamber as the material continues to enter the roll chamber and before the nose of the material is about to impact a middle portion of the material entering the roll chamber, with the third diameter being greater than the second diameter;

maintaining the two roll groups in the pre-determined final position until the material is completely inside the roll chamber and finished rolling up.

17. The process of claim 16, further comprising moving one of the rollers in each roll group toward the longitudinal central axis independent of one other roller in the roll group.

18. The process of claim 16, wherein driving the nose of the material comprises impacting one of the plurality of rollers in a bottom portion of the roll chamber.

19. The process of claim 16, further comprising forming a material infeed gap between the two roll groups.

20. The process of claim 19, wherein forming comprises locating the material infeed gap in a bottom portion of the roll chamber.

21. The process of claim 16, wherein rolling the plurality of rollers comprises causing the nose of the material to travel up along the circumference of the roll chamber as material continues to enter the roll chamber.

22. The process of claim 16, further comprising the plurality of rollers directly rolling against the material to roll up the material.

23. The process of claim 16, further comprising fixing the longitudinal axis of at least two of the rollers in the two roll groups such that the rollers are fixed in position relative to each other.

24. The process of claim 16, further comprising moving one of the rollers in each of the two roll groups away from the longitudinal central axis independent of one other roll group.

25. The process of claim 16, further comprising fixing one of the rollers in each roll group relative to the longitudinal central axis and moving one of the rollers in each roll group toward or away from the longitudinal central axis.

26. The process of claim 16, further comprising providing the roll chamber with three modes being a closed mode, a partially closed mode and an open mode, and each moving step comprises doing so in the closed mode.

27. The process of claim 16, further comprising providing one roller independent of the two roll groups and locating the one roller around the circumference of the roll chamber positioned between the two roll groups.

28. The process of claim 16, further comprising forming a third roll group comprising two rollers.

29. The process of claim 28, further comprising moving one of the rollers in the third roll group toward or away from the longitudinal central axis independent of one other roller in the third roll group.

30. The process of claim 27, wherein the one roller independent of the two roll groups comprises a lug roller.

31. The process of claim 30, further comprising locating the lug roller in a bottom portion of the roll chamber.

32. The process of claim 16, wherein driving the material into the roll chamber is further comprising forming a material infeed gap in the circumference of the roll chamber and driving the material through the material infeed gap.

33. The process of claim 32, further comprising locating a lug roller adjacent to the material infeed gap and powering the lug roller to provide at least 50% of a force needed to drive rolling up the material for the last 20% length of travel of the material entering the roll chamber.

34. A process for rolling up compressed high expansion force material comprising:

forming a roll chamber, the roll chamber having a longitudinal central axis and comprising a plurality of rollers located around a circumference of the roll chamber;

forming the plurality of rollers into two roll groups, each roll group comprising two rollers;

driving the material into the roll chamber against at least one of the plurality of rollers;

rolling the plurality of rollers to cause a the nose of the material to travel along the circumference of the roll chamber as material continues to enter the roll chamber;

moving one of the rollers in each of the two roll groups:

(i) away from the longitudinal central axis independent of one other roller in the roll group, and (ii) from a first position to a final position, where the first position is located closer to the longitudinal central axis than the final position is located to the longitudinal central axis; and, maintaining the two roll groups in the final position until the material is completely inside the roll chamber and finished rolling up.

35. The process of claim 34, wherein moving further comprises from a pre-determined first position to a pre-determined final position.

36. The process of claim 34, further comprising moving one of the rollers in each roll group toward the longitudinal central axis independent of one other roller in the roll group.

37. The process of claim 34, wherein rolling the plurality of rollers further comprises causing the nose of the material to travel along the circumference of the roll chamber past three significant roller gaps as material continues to enter the roll chamber.

38. The process of claim 34, further comprising the plurality of rollers directly rolling against the material to roll up the material.

39. The process of claim 34, further comprising fixing the longitudinal axis of two of the rollers in each of the roll groups such that the rollers are fixed in position relative to each other.

40. The process of claim 34, further comprising fixing one of the rollers in each roll group relative to the longitudinal central axis and moving one of the rollers in each roll group toward or away from the longitudinal central axis.

41. The process of claim 34, further comprising providing the roll chamber with three modes being a closed mode, a partially closed mode and an open mode, and moving comprises doing so in the closed mode.

42. The process of claim 34, further comprising providing one roller independent of the two roll groups and locating the one roller around the circumference of the roll chamber positioned between the two roll groups.

43. The process of claim 34, further comprising forming a third roll group comprising two rollers.

44. The process of claim 34, wherein driving the material into the roll chamber is further comprising forming a material infeed gap in the circumference of the roll chamber and driving the material through the infeed gap.

45. The process of claim 34, further comprising locating a lug roller adjacent to the material infeed gap and independently powering the lug roller to drive rolling up the material.

46. A process for rolling up material comprising:

forming a roll chamber, the roll chamber having a longitudinal central axis and comprising a plurality of rollers located around a circumference of the roll chamber;

forming the plurality of rollers into two roll groups, each roll group comprising two rollers;

moving the two roll groups into a pre-determined first position defining a first diameter of the roll chamber before the material enters a nip area upstream of the roll chamber;

driving the material toward the roll chamber;

moving the two roll groups into a pre-determined second position defining a second diameter of the roll chamber as the material enters the nip area, with the second diameter being greater than the first diameter;

driving a nose of the material into the roll chamber and against at least one of the plurality of rollers;

rolling the plurality of rollers to cause the nose of the material to travel along the circumference of the roll chamber as material continues to enter the roll chamber;

moving the two roll groups into a pre-determined final position defining a third diameter of the roll chamber as the material continues to enter the roll chamber and before the nose of the material is about to impact a middle portion of the material entering the roll chamber, with the third diameter being greater than the second diameter;

maintaining the two roll groups in the pre-determined final position until the material is completely inside the roll chamber and finished rolling up; and, fixing one of the rollers in each roll group relative to the longitudinal central axis and moving one of the rollers in each roll group toward or away from the longitudinal central axis.

47. The process of claim 46, further comprising providing one roller independent of the two roll groups and locating the one roller around the circumference of the roll chamber positioned between the two roll groups.

48. The process of claim 47, wherein the one roller independent of the two roll groups comprises a lug roller.

49. The process of claim 48, further comprising locating the lug roller in a bottom portion of the roll chamber.

50. A process for rolling up material comprising:

forming a roll chamber, the roll chamber having a longitudinal central axis and comprising a plurality of rollers located around a circumference of the roll chamber;

forming the plurality of rollers into two roll groups, each roll group comprising two rollers;

moving the two roll groups into a pre-determined first position defining a first diameter of the roll chamber before the material enters a nip area upstream of the roll chamber;

driving the material toward the roll chamber;

moving the two roll groups into a pre-determined second position defining a second diameter of the roll chamber as the material enters the nip area, with the second diameter being greater than the first diameter;

driving a nose of the material into the roll chamber and against at least one of the plurality of rollers wherein driving the material into the roll chamber is further comprising forming a material infeed gap in the circumference of the roll chamber and driving the material through the material infeed gap;

rolling the plurality of rollers to cause the nose of the material to travel along the circumference of the roll chamber as material continues to enter the roll chamber;

moving the two roll groups into a pre-determined final position defining a third diameter of the roll chamber as the material continues to enter the roll chamber and before the nose of the material is about to impact a middle portion of the material entering the roll chamber, with the third diameter being greater than the second diameter;

maintaining the two roll groups in the pre-determined final position until the material is completely inside the roll chamber and finished rolling up; and, locating a lug roller adjacent to the material infeed gap and powering the lug roller to provide at least 50% of a force needed to drive rolling up the material for the last 20% length of travel of the material entering the roll chamber.

51. The process of claim 50, further comprising fixing the longitudinal axis of two of the rollers in each of the roll groups such that the rollers are fixed in position relative to each other.

52. The process of claim 50, further comprising providing the roll chamber with three modes being a closed mode, a partially closed mode and an open mode, and moving comprises doing so in the closed mode.

53. The process of claim 50, further comprising locating the lug roller adjacent to the material infeed gap and independently powering the lug roller to drive rolling up the material.

* * * * *